US005117688A

United States Patent [19]

Reinke et al.

[11] Patent Number: 5,117,688

[45] Date of Patent: Jun. 2, 1992

[54] APPARATUS AND METHOD FOR REMOVING A VERY OPEN SHELL FROM A FORMING MANDREL

[75] Inventors: Stephen M. Reinke, Rochester; James C. Foote, Jr., York; Thomas A. Cipolla, Rochester; William G. Hoyt, Churchville; Lyndon R. Hutteman; Joseph A. Watkins, both of Rochester, all of N.Y.

[73] Assignee: Eastman Kodak Company, Rochester, N.Y.

[21] Appl. No.: 622,987

[22] Filed: Dec. 6, 1990

[51] Int. Cl.[5] ..... B21D 51/54; B65B 43/08

[52] U.S. Cl. ..... 72/426; 53/563; 29/173; 29/806; 198/474.1; 198/803.14; 72/423

[58] Field of Search ..... 72/215, 216, 379.2, 72/379.4, 423, 426; 29/172, 173, 225, 229, 806; 53/456, 563; 413/69, 71, 72, 74, 76; 198/474.1, 476.1, 477.1, 803.14, 803.15

[56] References Cited

U.S. PATENT DOCUMENTS

| | | | |
|---|---|---|---|
| 2,084,411 | 6/1937 | Robarge | 29/173 |
| 2,166,089 | 7/1939 | Brenner | 29/229 |
| 2,597,381 | 5/1952 | Roper | 29/229 |
| 2,940,232 | 6/1960 | Wallace et al. | 53/112 |
| 3,068,437 | 12/1962 | Jones | 29/173 |
| 3,422,966 | 1/1969 | Iansons | 198/474.1 |
| 3,466,845 | 9/1969 | Beekes et al. | 53/194 |
| 3,586,258 | 6/1971 | Horlezerder | 242/197 |
| 4,080,711 | 3/1978 | Kawada et al. | 29/427 |
| 4,115,913 | 9/1978 | Moriya et al. | 29/450 |
| 4,506,779 | 3/1985 | Seragnoli | 198/474.1 |
| 4,614,019 | 9/1986 | Shimizu et al. | 29/450 |
| 4,656,737 | 4/1987 | Shimizu et al. | 29/806 |
| 4,657,054 | 4/1987 | Schaltegger | 198/474.1 |
| 4,823,536 | 4/1989 | Manservigi et al. | 198/476.1 |
| 4,974,316 | 12/1990 | Suzuki et al. | 29/806 |

FOREIGN PATENT DOCUMENTS

| | | | |
|---|---|---|---|
| 55-77949 | 6/1980 | Japan | 29/806 |
| 58-184027 | 10/1983 | Japan | 29/173 |

*Primary Examiner*—Robert L. Spruill
*Assistant Examiner*—Donald M. Gurley
*Attorney, Agent, or Firm*—Charles E. Snee, III

[57] ABSTRACT

An apparatus and method are provided for removing a very open shell (28) from a forming mandrel (76), the mandrel being configured so that when the shell is released from the mandrel, the shell springs to an open form. The apparatus includes a fixture (44) for receiving the shell from the mandrel after the shell has been formed and clamped in place, the fixture comprising a pair of spaced claw elements (308,310) having aligned openings (426) through which the mandrel and the shell can pass with the shell formed and clamped in place on the mandrel, the openings being sized to hold the shell in its open form due to the spring force of the shell, and a support (394) connected between the claw elements for maintaining the alignment of the openings. A universal mount (394,424) for the fixture enables it to be positioned accurately to receive the shell from the mandrel.

11 Claims, 17 Drawing Sheets

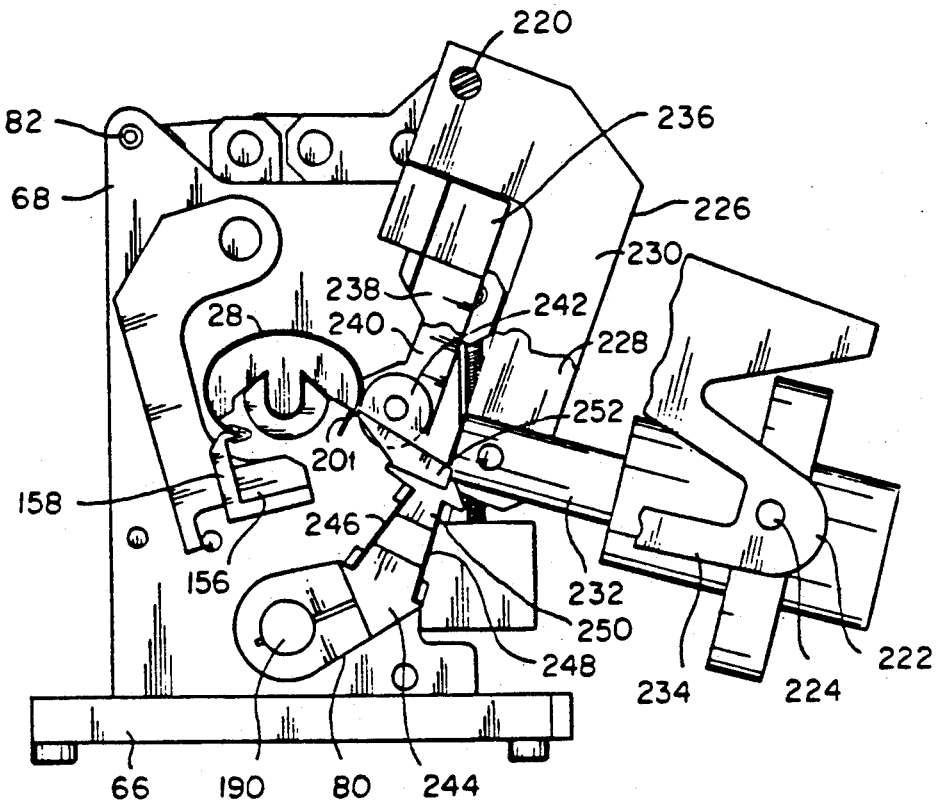
FIG. 14
FIG. 15
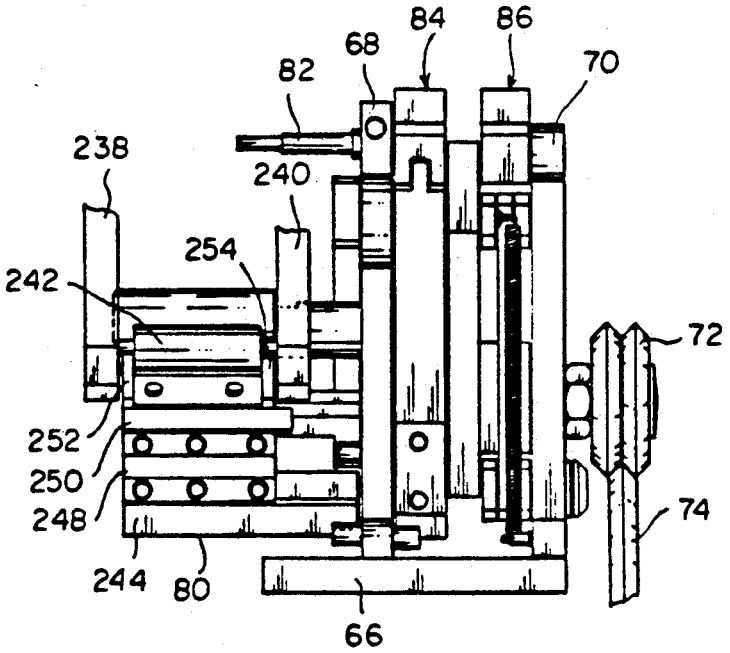

FIG. 27
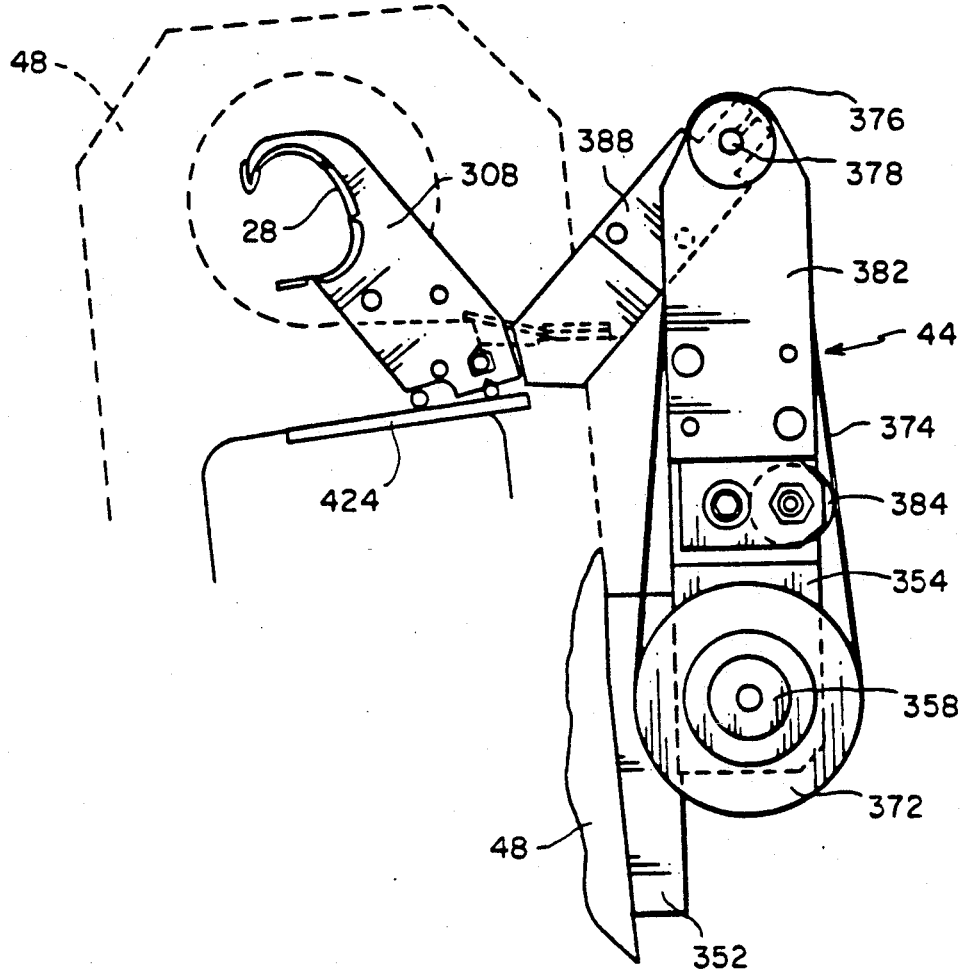
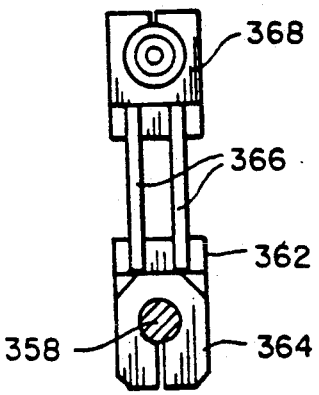
FIG. 29

APPARATUS AND METHOD FOR REMOVING A VERY OPEN SHELL FROM A FORMING MANDREL

CROSS REFERENCE TO RELATED APPLICATIONS

This application is related to the following concurrently filed applications of: (1) James C. Foote, Jr., Robert F. Allen, Paul E. Bailey, Dean B. Campbell, Thomas A. Cipolla, William G. Hoyt, Robert L. Huseby, Lyndon R. Huttemann, David H. Lancy. William C. Lebbon, Stephen M. Reinke, Thomas E. Stark and Joseph A. Watkins for Apparatus and Method for Forming and Loading a Magazine for Prewound Spools of Web Material, Ser. No. 622,985 filed Dec. 6, 1990 and now U.S. Pat. No. 5,044,144; (2) Stephen M. Reinke, Robert F. Allen, Paul E. Bailey, Thomas A. Cipolla, James C. Foote, Jr. and Robert L. Huseby and Thomas E. Stark for Apparatus and Method for Forming a Very Open Shell for Lateral Loading of Product, Ser. No. 622,989 filed Dec. 6, 1990; and (3) James C. Foote, Jr. and Lyndon R. Huttemann for Apparatus and Method for Applying End Caps to Cylindrical Shells, Ser. No. 623,629 filed Dec. 6, 1990.

DESCRIPTION

1. Technical Field

The present invention concerns methods and apparatus for removing formed shells from a forming mandrel. More particularly, the invention concerns such methods and apparatus which are suitable for use with a very open form shell which springs open when released from its forming mandrel to a configuration suitable for radially, laterally inserting a spool of web material or other product.

2. Background Art

A considerable variety of methods and apparatus have been developed over the years for winding and packaging strips of web material. For example, U.S. Pat. No. 2,940,232 discloses such an apparatus for use with photographic film in which strips of film are wound on spools, after which the wound spools are inserted axially into previously formed cylindrical magazine shells to which one end cap has already been applied, the shells having axially extending lips through which the leader of the film strip extends in the familiar manner. The cap for the open end of the shell is later applied. U.S. Pat. No. 3,466,845 discloses a multistation packaging apparatus in which a bendable chipboard blank is pressed into an elongated arcuate shape having an axially extending slot through which a wound core of product can be inserted, after which end caps are applied. U.S. Pat. No. 3,586,258 shows an apparatus for winding photographic film in which a previously formed magazine is provided which has axially extending lips. The spool is automatically oriented within the magazine to permit a guide tongue to insert film through the lips and into engagement with the core of the spool, after which the film is wound onto the spool within the magazine. U.S. Pat. No. 4,080,711 discloses another apparatus in which the film is inserted into an already complete magazine and wound onto the spool within the magazine. U.S. Pat. Nos. 4,115,913 and 4,614,019 show somewhat different types of methods and apparatus for winding film and loading prewound spools into magazines, in which the magazine shells are preformed with a rather wide axially extending slot, to facilitate axial insertion of a prewound spool of film, after which the shells are closed and end caps are applied.

While automatic packaging apparatus and methods of the types just discussed have achieved a measure of acceptance and success over the years, a need has continued to exist for apparatus and methods suitable for still higher rates of production, without sacrificing quality of the finished package or damaging the product during the packaging process. Particularly for winding and packaging photographic films and other sensitized materials which must be handled in near total darkness, a need has existed for such more productive equipment which would require a minimum of operator intervention during use, thus leading to still further improved rates of production.

SUMMARY OF THE INVENTION

A primary objective of this invention is to provide a method and apparatus for removing a very open shell from a forming mandrel while holding the shell in a configuration suitable for radially, laterally inserting a spool or web material or other product.

A further objective of this invention is to provide such an apparatus which positions itself relative to such a forming mandrel for proper removal of the shell, without regard for small variations in the position of the mandrel at the time of removal.

Still another objective of this invention is to provide such an apparatus which following removal of the shell from the mandrel repositions the shell to receive such a spool or other product.

Yet another objective of this invention is to provide such an apparatus which holds the shell in such a way as to permit access by means for closing the shell about the spool or other product.

A still further objective of this invention is to provide such an apparatus which holds the shell in such a way as to permit application of end caps to the shell after it has been closed about the spool or other product.

These objectives are given only by way of illustrative examples; thus, other desirable objectives and advantages inherently achieved by the disclosed apparatus and method of the invention may occur or become apparent to those skilled in the art. Nonetheless, the scope of the invention is to be limited only by the appended claims.

At a shell removal station, the mandrel and the shell clamped to the mandrel after forming are moved essentially parallel to the axis of rotation of the forming dial which supports the mandrel to a position where the mandrel and shell enter a pair of fixed claws of a nest fixture of a shell removal mechanism according to the invention. The clamps holding the shell are then released, permitting the shell to spring open into the nest fixture; and the mandrel is withdrawn. The shell removal mechanism preferably is mounted on an adjacent assembly dial and comprises at least one transfer arm pivotably connected to the assembly dial. The fixed claws of the mechanism are mounted on this transfer arm. Upon rotation of the assembly dial, the transfer arm rotates away from the shell removal station and repositions the very open shell for insertion of a spool or other product, closure of the shell about the spool or other product and application of end caps to the closed shell.

The fixed claws of the shell removal mechanism are spaced axially somewhat less than the length of the very open shell to leave room between the claws for access by a mechanism for closing the shell and outboard of the claws for installation of end caps. The claws have aligned openings through which the mandrel and the shell can pass and into which the very open shell can spring open to be held after its release from the mandrel. To facilitate alignment with the mandrel and with means for applying end caps, the support for the fixed claws is provided with a substantially universal attachment to the transfer arm, thus permitting the support to move enough to account for misalignments of the apparatus. To pivot the transfer arm away from the shell removal station, a stationary cam track is provided around the axis of rotation of the assembly dial and a cam follower attached to the transfer arm is engaged with the stationary cam track as the assembly dial rotates.

BRIEF DESCRIPTION OF THE DRAWINGS

The foregoing and other objectives, features and advantages of the invention will be apparent from the following more particular description of the preferred embodiments of the invention, as illustrated in the accompanying drawings.

FIG. 14 shows the mechanism of FIG. 13 with the forming roller rotated about the mandrel to complete forming a very open form shell from the metal blank and with both ends of the shell clamped to the mandrel.

FIG. 15 shows a view of the right side of the mechanism of FIG. 14, partially broken away to illustrate the cooperation of the forming roller with the clamp for the end of the shell.

FIG. 27 shows a front elevation view of the means for removing a roll formed shell.

FIG. 29 shows a view of the cam follower arm of the mechanism of FIG. 28, taken along line 29—29 in FIG. 28.

DESCRIPTION OF THE PREFERRED EMBODIMENTS

Figure 1:
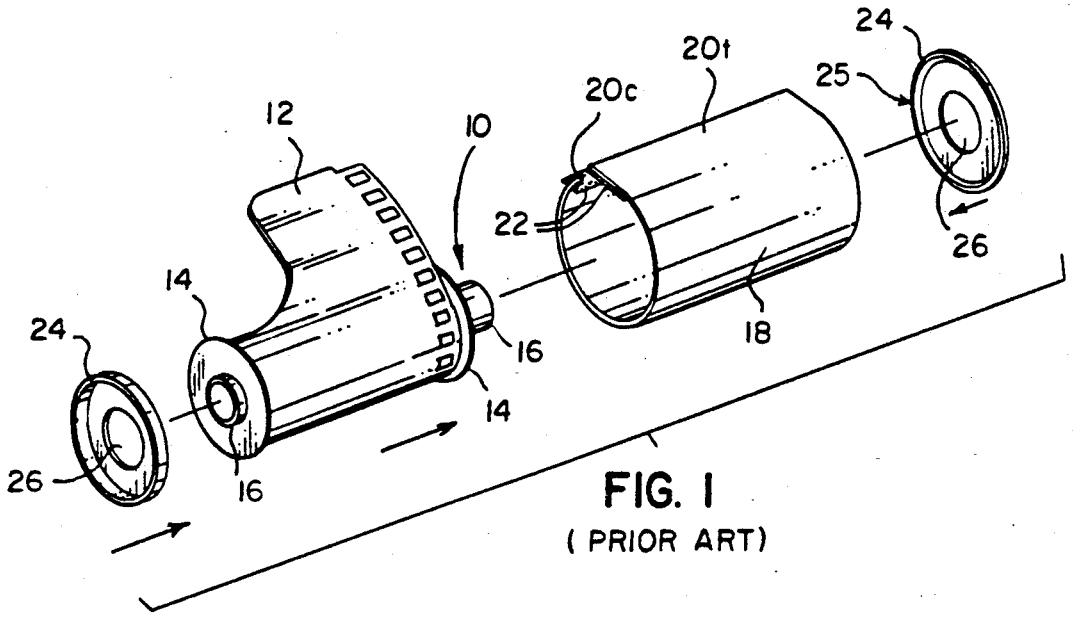
FIG. 1 ( PRIOR ART)
FIG. 1 shows an exploded perspective view of a known type of magazine for photographic film, illustrating one prior art technique for inserting a prewound spool axially into the shell of the magazine and applying the end caps.

The following is a detailed description of the preferred embodiments of the invention, reference being made to the drawings in which the same reference numerals identify the same elements of structure in each of the several Figures.

PRIOR ART METHOD

FIG. 1 illustrates a known process for loading photographic film magazines. A spool 10 has been used which comprises a central core, not illustrated, on which is wound a strip 12 of photographic film. Spool 10 includes a pair of end flanges 14 from which extend hollow axial hubs 16. A preformed metal shell 18 has been used which comprises a pair of axially extending lips 20c,20t between which strip 12 is withdrawn from or wound back into the magazine in use by the consumer. These axially extending lips typically are different in geometry, lip 20c being folded or crimped back on itself and lip 20t being essentially tangent to the cylindrical preformed shell 18. Typically, preformed shell 18 has been formed from a substantially flat rectangular blank, not illustrated, in which lips 20c,20t have previously been formed. To prevent leakage of light into the magazine, lips 20c and 20t have for many years been covered with a lightlock material 22 such as black velvet or plush which firmly but gently engages the surfaces of the film and prevents light leakage into the magazine. The ends of the magazine are closed by a pair of annular end caps 24, each having an aperture 26 for rotatably receiving hubs 16 and a circumferentially extending groove and flange for fixedly engaging the end edges of preformed shell 18. Such magazines have been assembled by inserting the prewound spool of film axially into preformed shell 18 and then applying and staking end caps 24. While this spooling and assembling process is reliable and has been rather widely used, the apparatus for practicing the process tends to be limited in speed.

BASIC METHOD OF THE INVENTION

Figure 2:
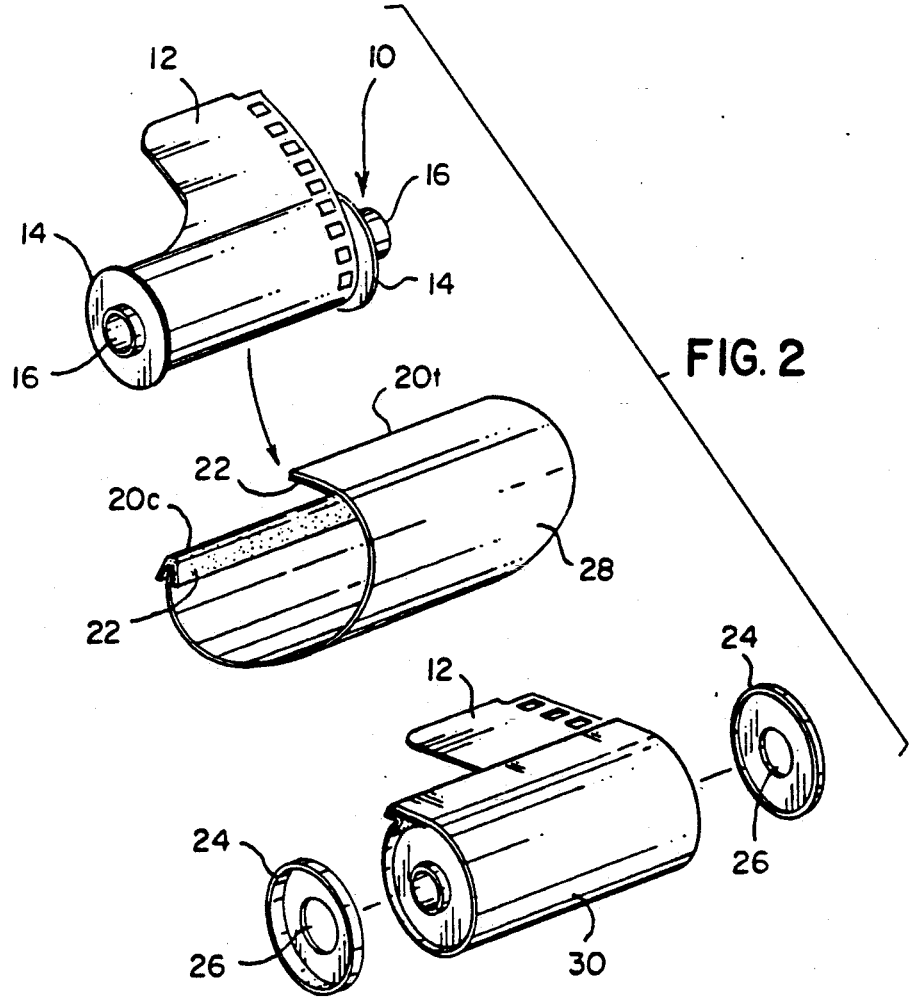
FIG. 2 shows an exploded perspective view of a known type of magazine for photographic film, illustrating a very open shell as positioned using the apparatus of the present invention to permit insertion of a prewound spool radially, laterally into the shell of the magazine and application of end caps.

FIG. 2 illustrates how a magazine is assembled using a very open shell positioned in accordance with the method and apparatus of the present invention. In this instance, instead of the essentially cylindrical preformed shell 18 used in the past to permit axial insertion of the prewound spool, a very open preformed metal shell 28 is provided. Very open shell 28 is configured such that axially extending lips 20c,20t are spaced far enough apart to permit the prewound spool to be inserted laterally or radially into shell 28. Then, very open shell 28 is closed about the prewound spool to a substantially cylindrical configuration 30 with the lead end of strip 12 captured between lips 20c,20t. Then end caps 26 are applied and staked to complete the magazine. In the remainder of this specification, the method and apparatus will be described for positioning the very open shell 28 to facilitate inserting a prewound spool therein, closing the shell and applying the end caps.

OVERALL OPERATION

Figure 3:
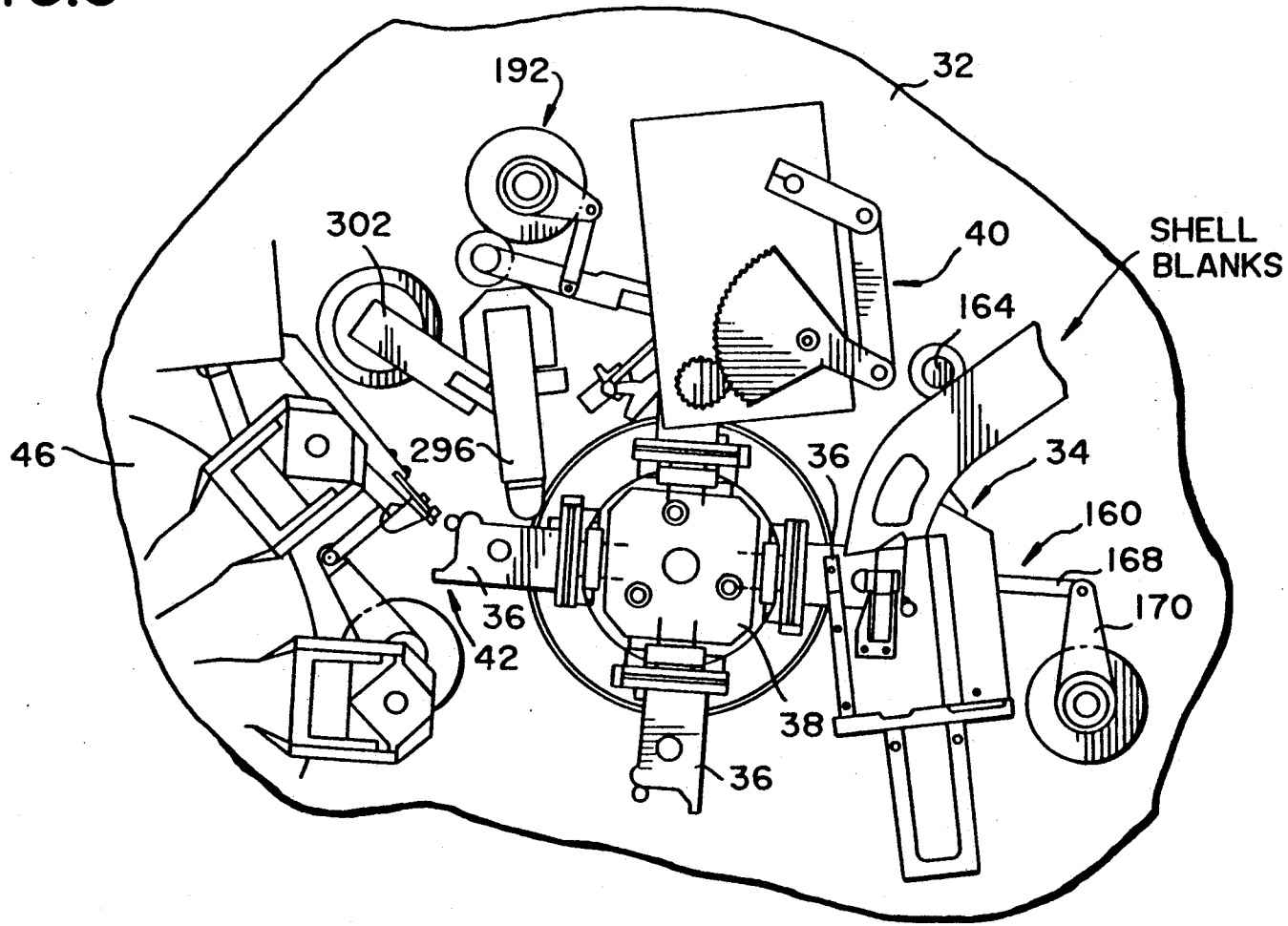
FIG. 3 shows a simplified, fragmentary, schematic front elevation view of an apparatus in which the invention is particularly useful.

FIG. 3 illustrates a portion of the overall layout of a spooling system incorporating the apparatus according to the invention. A rigid, vertically standing face plate 32 is preferred to provide a mount for the components of the system; however, face plate 32 may be oriented differently or replaced with a structural framework. A shell blank feeding mechanism 34 receives substantially flat, rectangular metal blanks to be formed into the cylindrical side wall of the completed magazine, each blank having been previously provided with lips 20c,20t and lightlock strips 22. The shell blanks are fed one at a time to sequentially presented forming mandrels mounted on mandrel carriers 36 which in turn are mounted on a first forming dial 38 which rotates intermittently to index mandrel carriers 36 from position to position. As forming dial 38 is indexed, each mandrel carrier 36, having received a shell blank from feeding mechanism 34, is presented to a forming station 40 where very open shell 28 is formed about the mandrel. As forming dial 38 is indexed again, each mandrel carrier, with very open shell 28 formed about its mandrel, is presented to a shell removal station 42 where very open shell 28 is removed from the mandrel by a shell removal mechanism 44 in accordance with the present invention. Mechanism 44 is illustrated in FIGS. 20 to 30 and is mounted on an adjacent assembly dial 46.

As assembly dial 46 is indexed away from removal station 42, removal mechanism 44 is rotated by a cam and follower to position very open form shell 28 between the movable jaws of one of a plurality of end cap applying mechanisms 48 also mounted on dial 46. Then when dial 46 has stopped, an end cap placing mechanism, not illustrated, transfers a pair of end caps to magnetic holders on the anvils of end cap applying mechanism 48 between which very open shell 28 has been positioned. Assembly dial 46 continues to index until a magazine assembly station, not illustrated, is reached where a prewound spool will be inserted.

While the overall operations described in the preceding paragraphs are taking place, empty spools are provided to a spool winding station, which is described in copending, commonly assigned application Ser. No. 595,130. Once a spool has been wound, it is picked up and swung up into the waiting very open shell 28 within one of mechanisms 48 at the assembly station. A shell closing mechanism, not illustrated, is then actuated to surround very open shell 28 within one of mechanisms 48 and close it about the prewound spool. End cap applying mechanism 48 is actuated to close its jaws and apply end caps 24 to the now cylindrical end edges of the shell. The shell closing mechanism is then withdrawn to permit assembly dial 46 to index to end cap staking station, not illustrated, where end caps 24 are staked into firm engagement with the cylindrical walls of the completed magazine. Assembly dial 46 then indexes to a magazine removal station, not illustrated, where the jaws of end cap applying mechanism 48 are opened and the completed magazine is removed by a magazine removal mechanism, not illustrated.

SHELL FEEDING AND ROLL FORMING STATIONS 34,40

Figure 4:
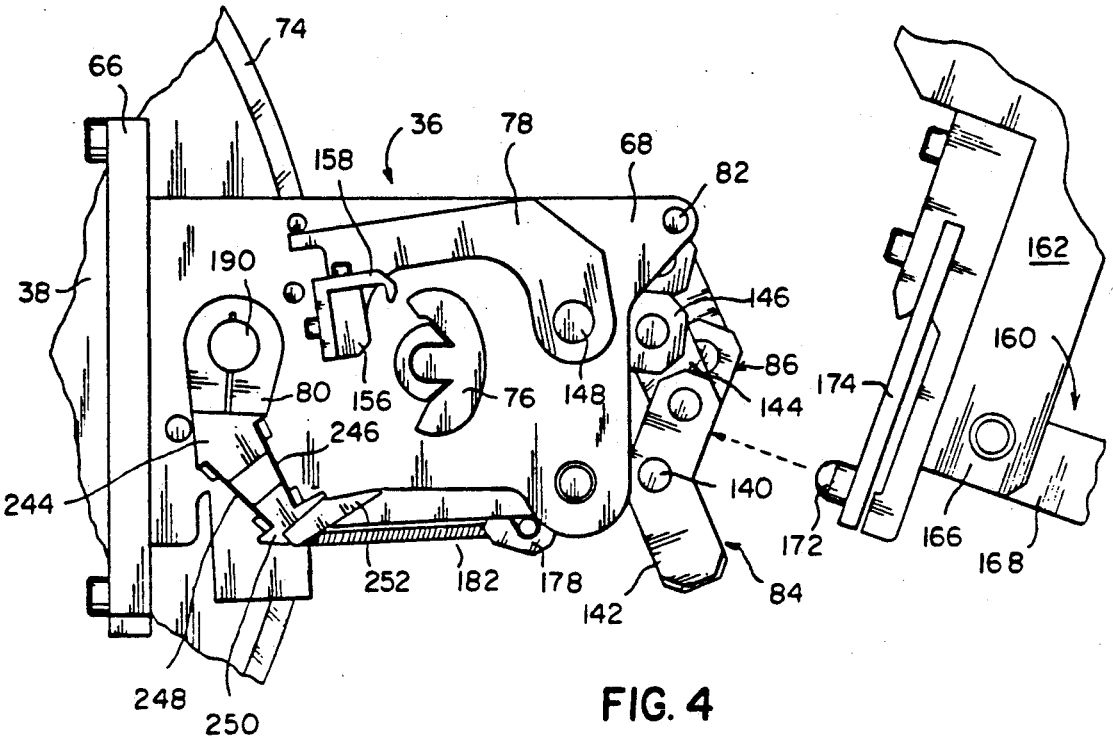
FIG. 4 shows an enlarged, fragmentary front elevation view of the apparatus of FIG. 3, illustrating the mandrel used to form a shell to be removed from the mandrel in accordance with the invention.
Figure 5:
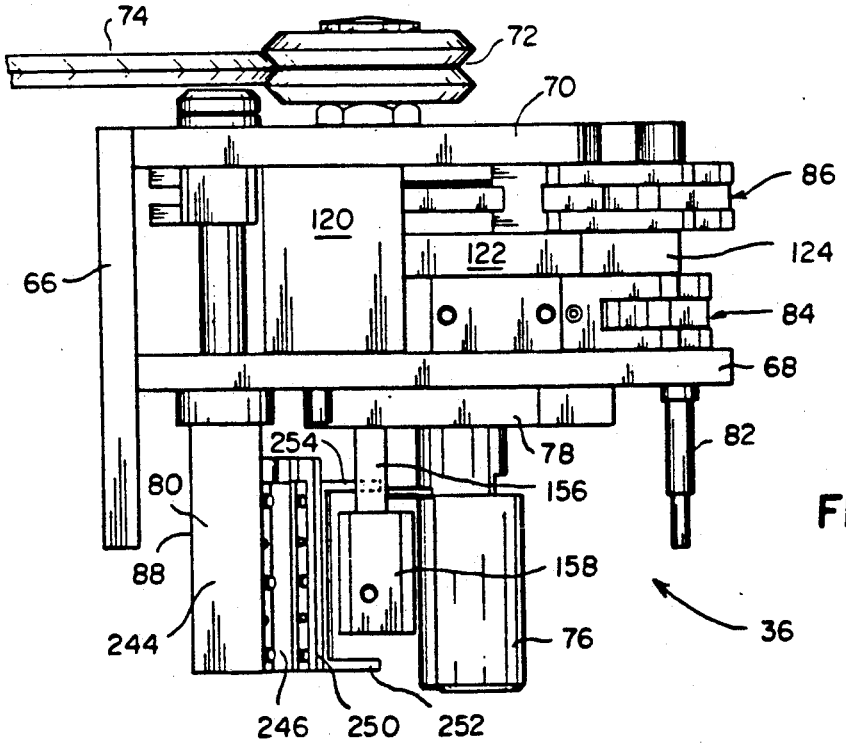
FIG. 5 shows a top plan view of a portion of the apparatus of FIG. 4.
Figure 6:
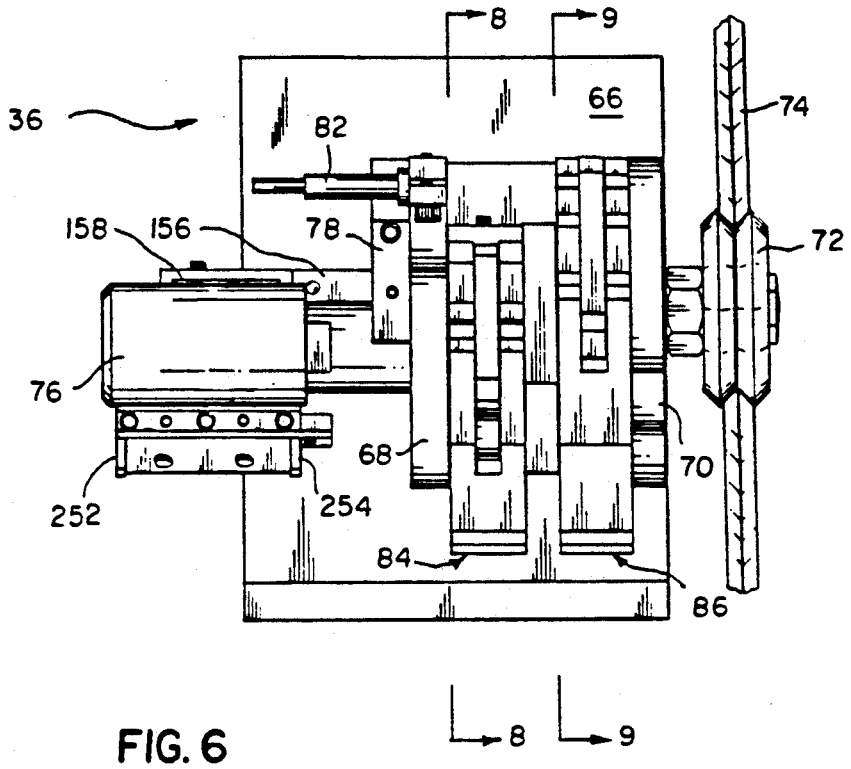
FIG. 6 shows a side elevation view of the apparatus of FIG. 4, taken from the right side as viewed in FIG. 4.

FIGS. 4, 5 and 6 show front, top and right side views of one of mandrel carriers 36 as positioned for delivery of a substantially flat, metal shell blank. Each mandrel carrier 36 is mounted on forming dial 38 via a carriage, not shown in FIGS. 4, 5 and 6, which permits the mandrel carrier to be moved in and out of the plane of FIG. 4, as will be discussed in greater detail with regard to FIGS. 20, 21 and 22. Each mandrel carrier 36 comprises a base plate 66 from which extend radially a pair of front and rear side plates 68, 70. On the rear surface of side plate 70 is mounted a grooved guide wheel 72 which engages a circular guide track 74 fixed to face plate 32 behind dial 38, to axially position each mandrel carrier 36 as forming dial 38 rotates from position to position. On the front surface of side plate 68 are mounted a fixed roll forming mandrel 76, a first rotatable clamping arm 78, a second rotatable clamping arm 80 and a stop pin 82 for the shell blank. Between side plates 68,70 are located over-center toggle linkages 84 for rotating clamping arm 78 to initially clamp lip 20c of a shell blank against mandrel 76 prior to and during roll forming, and 86 for rotating clamping arm 80 to subsequently clamp lip 20*t* of the rolled shell blank against mandrel 76 after roll forming.

Figure 7:
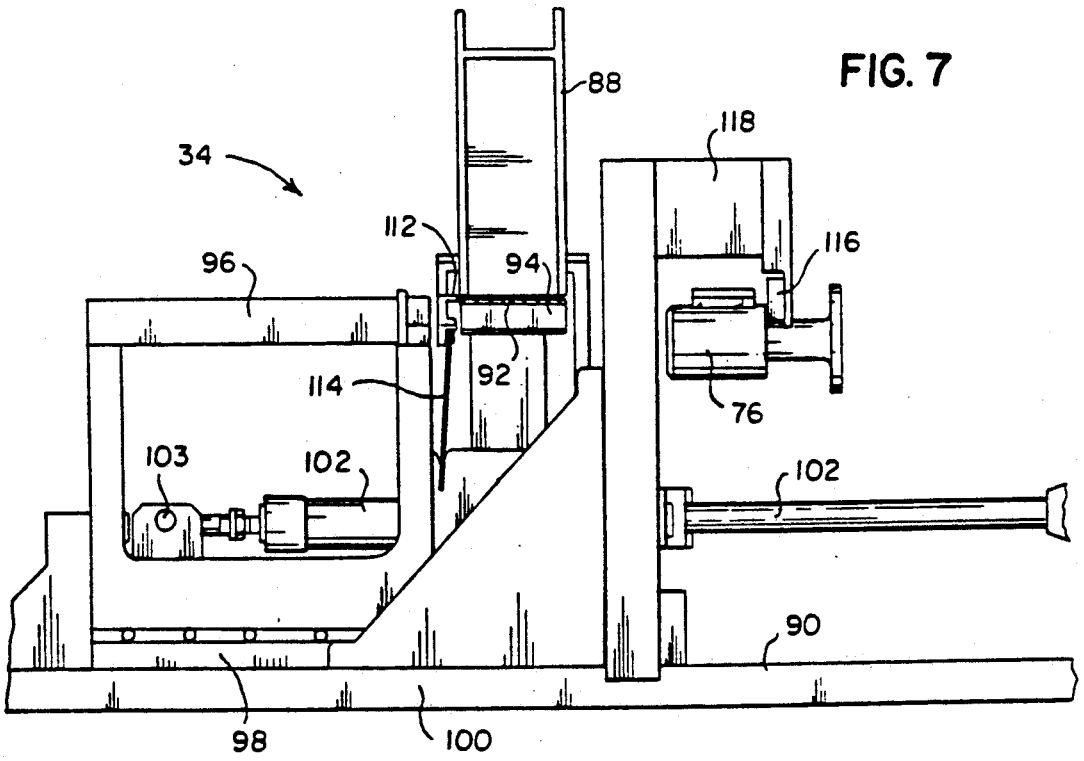
FIG. 7 shows a side elevation view of the apparatus for delivering metal blanks to the forming mandrel in accordance with the invention, taken from the right side as viewed in FIG. 3.
Figure 10:
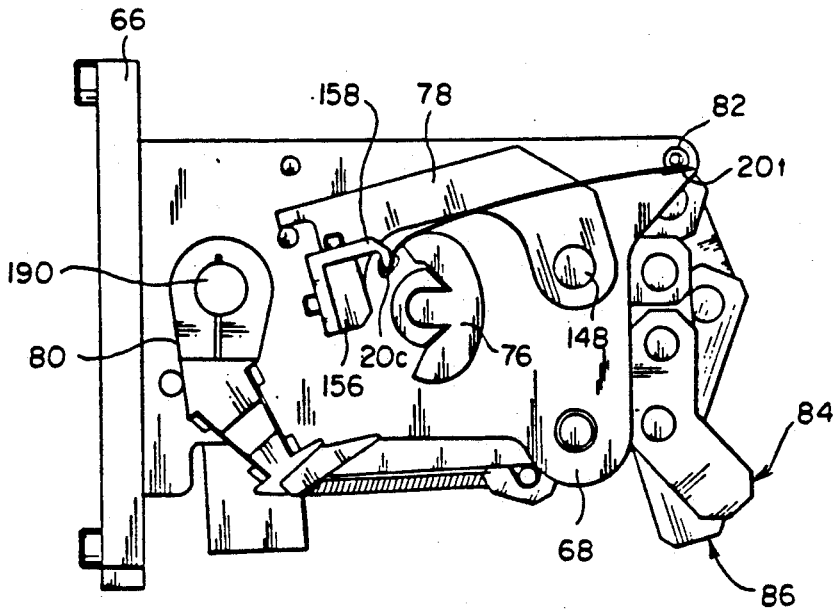
FIG. 10 shows the apparatus of FIG. 4 after a metal blank has been delivered to the mandrel and clamped in place.

FIG. 7 illustrates schematically the shell blank feeding mechanism 34 used to present a metal shell blank to mandrel 76 for roll forming. A supply of such blanks is maintained by the operator in a gravity feed chute 88 mounted on a frame member 90 attached to face plate 32. The lowermost blank 92 is withdrawn from chute 88 by a magnet 94 and positioned in a plane tangent to the upper edge of mandrel 76 as viewed in FIG. 4. The upper surface of magnet 94 is located in this plane and magnet 94 is supported on a frame 96 which is mounted on a slide 98 supported by a frame member 100 attached to face plate 32. To deliver blank 92 to mandrel 76, frame 96 is pulled along slide 98 by an actuator rod 102 which is pivoted at 103 to frame 96 and may be oscillated back and forth by a conventional rotating crank mechanism, not illustrated. As blank 92 slides onto the upper surface of mandrel 76, magnet 94 passes in front of mandrel 76, as viewed in FIG. 7. Blank 92 is prevented from rearward movement by a pair of positioning fingers 112, only one of which is visible in FIG. 7, which contact the trailing edge of blank 92 during movement and which are supported on a leaf spring 114 attached to frame 96. When frame 96 has reached the limit of its travel, the leading edge of blank 92 contacts a stop 116 supported by an arm 118 of frame 100. In this position, fingers 112 are biased against the trailing edge of the blank to hold it against stop 116. The use of leaf spring 114 makes it possible to use a continuously rotating crank mechanism, since the flexibility of the spring provides a brief dwell to hold the blank in place while the frame 96 stops and reverses direction. Rotatable clamping arm 78 is then actuated to clamp lip 20*c* against mandrel 76, which causes the end of the blank including lip 20*t* to swing up into contact with stop pin 82, as shown in FIG. 10. Frame 96 is then returned to the position shown in FIG. 7, where the next blank is drawn onto magnet 94.

Figure 8:
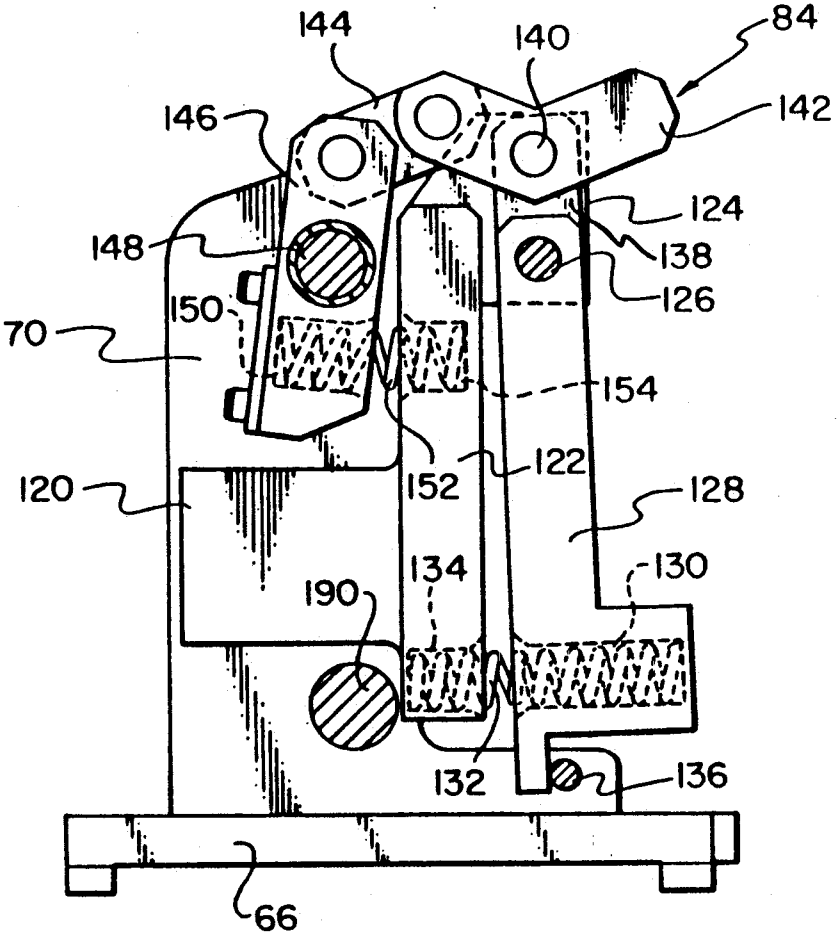
FIG. 8 shows a view along line 8—8 of FIG. 6.

FIG. 8 shows the toggle linkage 84 which actuates and releases rotatable clamping arm 78. An anchor block 120 extends between side plates 68,70. Preferably, block 120 includes, at a location essentially midway between side plates 68,70, an integral radially extending arm 122 having a transversely extending head 124 at its radially outer end. Pivoted on a shaft 126 between side plate 68 and head 124 is a load arm 128 having near its radially inner end a spring pocket 130 which captures one end of a spring 132 whose other end is captured in a spring pocket 134 located in the radially inner end of arm 122. Rotational movement of load arm 128 is limited by a stop pin 136 extending from side plate 68. On the opposite side of shaft 126 from spring pocket 130, arm 122 includes an extension 138 which supports a shaft 140 on which a vee-shaped trip arm 142 is rotatably mounted. One end of trip arm 142 is pivotably connected to one end of a link 144, the opposite end of which is pivotably connected to a pivot arm 146 fixedly mounted on a shaft 148 which is pivotably mounted between side plates 68,70. Pivot arm 146 includes a spring pocket 150 which captures one end of a spring 152, the other end of which is captured in a spring pocket 154 located in radially extending arm 122. Shaft 148 extends outwardly through side plate 68 where, as shown in FIG. 4, it supports rotatable clamping arm 78. As shown in FIGS. 4 and 5, arm 78 includes a transversely extending portion 156 which supports a hook member 158 for engaging lip 20*c* as shown in FIG. 10.

To operate the toggle linkage shown in FIG. 8, an actuator mechanism 160 is provided as shown schematically in FIG. 3 and fragmentarily in FIG. 4. An actuator arm 162 is pivoted at its upper end 164 to face plate 32 and at its lower end 166 to a connecting rod 168 operatively connected to a crank arm 170 which may be rotated by a conventional oscillator, not illustrated. When a shell blank has been placed in contact with stop 116, arm 170 is rotated to move connecting rod 168 and cause actuator arm 162 to move from the position shown in FIG. 4 toward the end of trip arm 142 connected to link 144. A contact button 172 is mounted on the free end of a cantilever leaf spring 174 attached to lower end 166 of actuator arm 162. Button 172 is pressed against trip arm 142, causing it to rotate counterclockwise as seen in FIG. 4. This movement causes shaft 148 to rotate so that hook member 158 engages lip 20*c* on the shell blank and moves the blank to the position shown in FIG. 10. Reverse motion of shaft 148 under the influence of springs 132 and 154 is prevented because the pivot point between trip arm 142 and link 144 moves over center. Thus, the shell blank is fixed near lip 20*c* to the outer surface of mandrel 76 and near lip 20*t* against stop pin 82.

Figure 9:
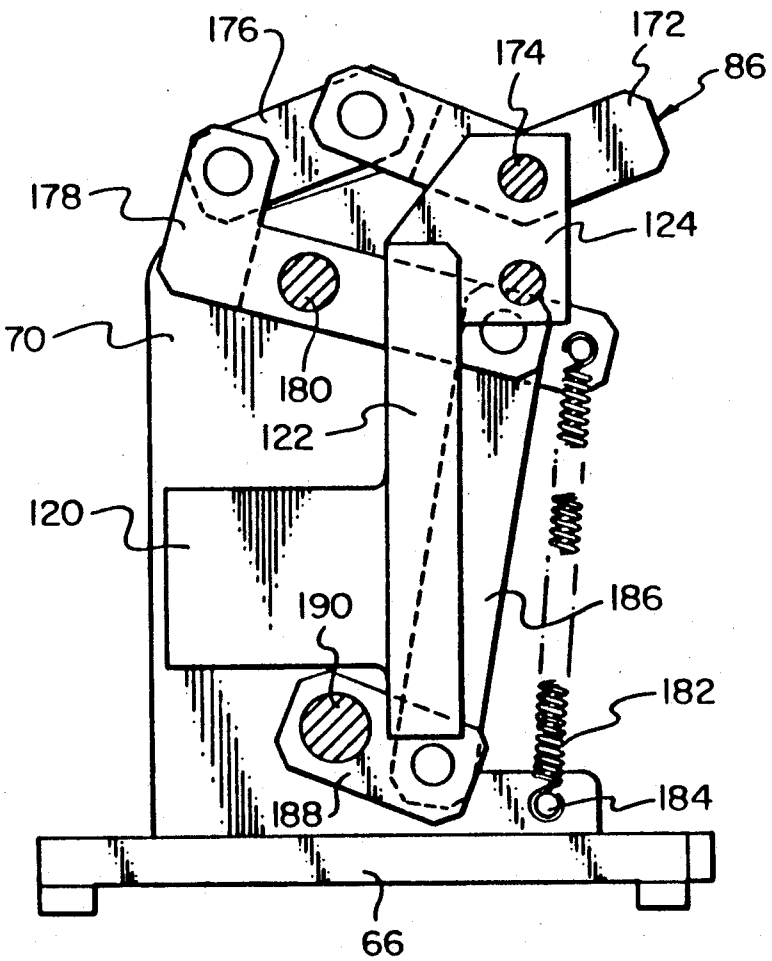
FIG. 9 shows a view along line 9—9 of FIG. 6.

Second rotatable clamping arm 80 is actuated and released by the toggle linkage 86 shown in FIG. 9. Near the radially outer edge of transversely extending portion 124, a vee-shaped trip arm 172 is pivotably mounted on a shaft 174 extending between portion 124 and side plate 70. One side of trip arm 172 is pivotably connected to one end of a link 176 whose opposite end is pivotably connected to an elongated crank arm 178 pivotably supported on a shaft 180 extending from side plate 170. At the opposite end of crank arm 178 from its connection to link 176, the crank arm is pulled radially inwardly by an extension spring 182 connected between the crank arm and a pin 184 extending from side plate 70. Between shaft 180 and the point of attachment of spring 182, an elongated link 186 is pivotably connected, the opposite end of link 186 being pivotably connected to a pivot arm 188 mounted for rotation with a shaft 190 which extends from side plate 70 through side plate 68 and supports rotatable clamping arm 80. The toggle linkage shown in FIG. 9 is operated by an actuator mechanism 192 shown schematically in FIG. 3 and in larger scale in FIG. 11, as will be discussed in detail subsequently.

Figure 11:
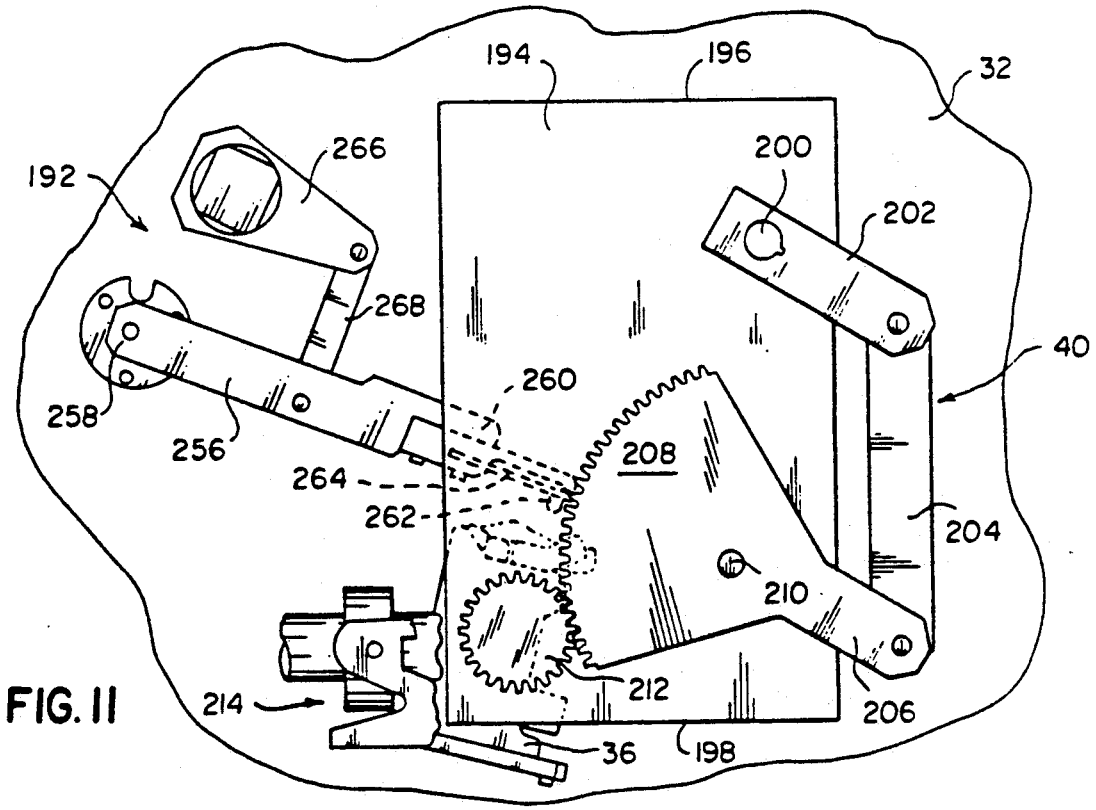
FIG. 11 shows a fragmentary front elevation view of the apparatus of FIG. 3, illustrating portions of the mechanism for roll forming a metal blank about the mandrel.

Once a shell blank has been placed in position on mandrel 76 as shown in FIG. 10, forming dial 38 is rotated by a conventional indexer, not illustrated, until mandrel carrier 36 is positioned at forming station 40. FIG. 11 shows an enlarged view of roll forming station 40. A support plate 194 is spaced in front of face plate 32 by supports extending behind its upper edge 196. Thus, the lower edge 198 of plate 194 is spaced from face plate 32 sufficiently to permit mandrel carrier 36 to move into position for forming of the shell blank positioned on mandrel 76. Preferably the shell blank is roll formed and the mechanism for actuating the roll former is mounted on or supported in part by support plate 194. This mechanism comprises an actuator shaft 200 mounted for reciprocating rotation in support plate 194 and face plate 32, a crank arm 202 mounted for rotation with shaft 200, a link 204 pivotably connected at one end to crank arm 202 and at the other end to a pivot arm 206 formed integrally with a gear sector 208 mounted for rotation on an axle 210 journaled in plate 194. Actuator shaft 200 may be driven by a conventional indexer, not illustrated. A pinion gear 212 is mounted for rotation in support plate 194, meshed with gear sector 208 and operatively connected to the roll former as shown in FIG. 12.

Figure 12:
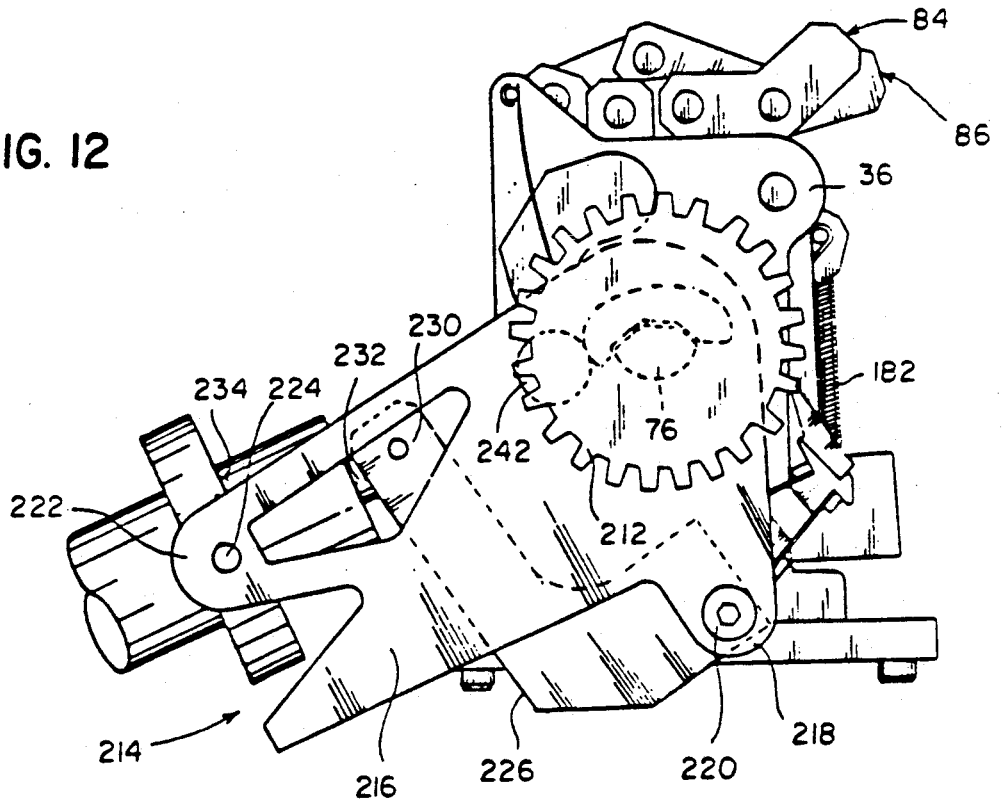
FIG. 12 shows the mechanism of FIG. 11 with its front plate and gear train removed and with the mechanism of FIG. 4 rotated into position for roll forming of the metal blank.
Figure 13:
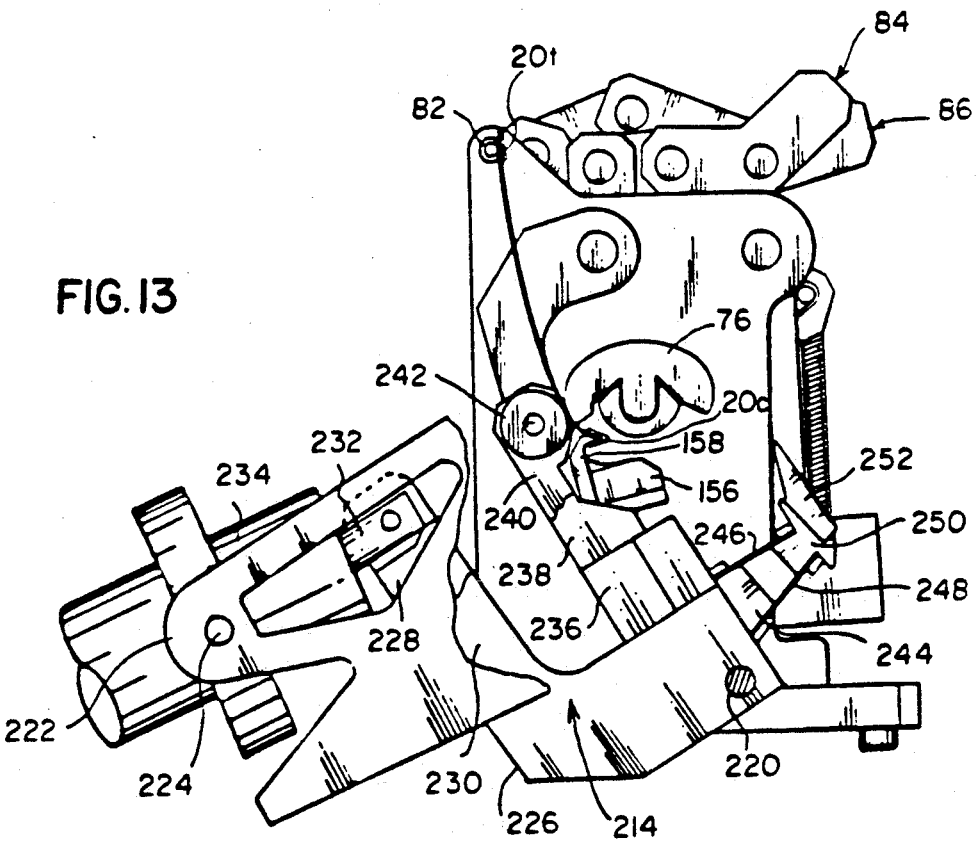
FIG. 13 shows the mechanism of FIG. 12 partially broken away to illustrate the cooperation of the forming roller with the metal blank and the mandrel.

In FIG. 12, support plate 194 has been removed from view, leaving visible only pinion gear 212 and mandrel carrier 36, while revealing the roll former mechanism 214. An elongated support plate 216 is connected for reciprocating rotation to the shaft of pinion gear 212. The axis of pinion gear 212 preferably is parallel to all elements of the forming surface of mandrel 76, shown in phantom in FIG. 12. Along its lower edge as seen in FIG. 12, support plate 216 includes a downwardly projecting ear 218 which supports an axle 220 which extends beneath mandrel 76 in the positions of FIGS. 12 and 13. Along its upper edge as seen in FIG. 12 and at the opposite end from the location of axle 220, support plate 216 includes a further ear 222 which supports an axle 224. In FIGS. 13 and 14, support plate 216 has been partially broken away to reveal the components of roll former mechanism 214. Axle 220 rotatably supports a yoke 226 having a pair of arms 228,230 as seen in FIG. 13. The ends of arms 228,230 are positioned on opposite sides of and pivotably connected to the plunger rod 232 of a disk compression spring device 234 pivotably mounted on axle 224; so that, device 234 constantly biases yoke 226 to rotate about shaft 220 in the clockwise direction as viewed in FIG. 13. Those skilled in the mechanical arts will appreciate that device 234 may comprise a stack of disk springs captured within a cylinder and that movement of plunger rod 232 into such cylinder would compress the washers to produce the desired biasing force. Mounted on yoke 226 just above axle 220 is a forming roller support yoke 236 having a pair of arms 238,240 as seen in FIGS. 13 and 14. The ends of arms 238,240 are positioned at opposite ends of and rotatably support a forming roller 242. As mandrel carrier 36 is indexed into the position shown in FIGS. 12 and 13, the shell blank contacts forming roller 242 near lip **20*c* which, as previously discussed, has already been clamped against mandrel 76. As a result of this contact, forming roller 242 and yoke 226 pivot counterclockwise about shaft 220 as seen in FIGS. 12 and 13, causing plunger 232 to press inward against the springs in device 234, thereby firmly pressing forming roller 242** into engagement with the shell blank and the underlying mandrel.

To form the shell blank into very open shell 28 as shown in FIG. 2, crank arm 202 is rotated counterclockwise thereby causing gear sector 208 to rotate in the same direction which causes pinion gear 212 to rotate clockwise until roll forming mechanism 214 reaches the position of FIG. 14. During this rotation, the biasing force of device 234 holds forming roller 242 firmly in contact with the shell blank as roller 242 rolls the blank about the outer surface of mandrel 76. When roller 242 has reached a position near to lip **20*t* as shown in FIG. 14, toggle linkage 86 is actuated by mechanism 192, shown in FIG. 11, thereby causing shaft 190 to rotate clamping arm 80 to the position shown in FIG. 14. Mechanism 192 comprises an actuator arm 256 pivotably connected at its end 258 to face plate 32. At the opposite end 260 of arm 256, a toggle actuating button 262 is supported on a cantilever spring 264, as shown in phantom in FIG. 11. A crank arm 266 is pivotably mounted to face plate 32 for reciprocating rotation by a conventional oscillator, not illustrated, and is connected by a link 268 to actuator arm 256**.

When a shell blank has been roll formed to the configuration shown in FIG. 14, mechanism 192 is actuated to press trip arm 172 and link 176 toward shaft 180, thereby causing shaft 190 to rotate clamping arm 80 into engagement with the completed very open shell 28. As shown in FIGS. 4, 5, 14 and 15, clamping arm 80 comprises a transverse portion 244 which extends beneath forming roller 242 in the position of FIG. 14. A pair of canted leaf springs 246,248 are attached between portion 244 and a transverse bar 250 having at its opposite ends clamping fingers 252,254 which, when toggle linkage has been actuated to the position of FIGS. 14 and 15, extend between the ends of forming roller 242 and arms 238,240 of support yoke 236 and into contact with the shell blank near lip **20*t*. The use of canted leaf springs 246,248 causes bar 250 and clamping fingers 252,254 to rotate relative to portion 244 and thus to pull the shell in the direction of lip 20*t* to ensure good contact with the mandrel during subsequent processing. Thus, very open shell 28 is held firmly against mandrel 76. With roll former mechanism 214 in the position of FIG. 14, mandrel carrier 36 can be indexed away to shell removal station 42, after which shaft 200 is rotated in the opposite direction, to return roll former mechanism 214 to the position of FIG. 11**, ready to receive the next mandrel carrier.

GEOMETRY OF FORMING MANDREL 76

FIGS. 16 to 19 illustrate a preferred technique for determining the geometry of the exterior surface of mandrel 76 about which the shell blank is formed. The objectives in determining this geometry are to ensure (a) that when a substantially flat, rectangular metal shell blank is formed about the exterior surface from near lip **20*c* to near lip 20*t* and the blank is then removed from the mandrel, the blank will spring to a very open form in which lips 20*c*,20*t* are spaced sufficiently far apart as seen in FIG. 2 to permit a previously wound spool to pass laterally or radially between lips 20*c*,20*t* with the trailing end of the film on the spool projecting outwardly between the lips; and (b) that after lateral insertion of the prewound spool, the blank can be closed to form a substantially cylindrical shell to which end caps 24** can be readily applied.

Figure 16:
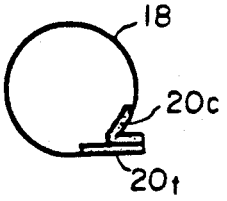
FIG. 16 shows a simplified cross sectional view of a magazine for photographic film.
Figure 17:
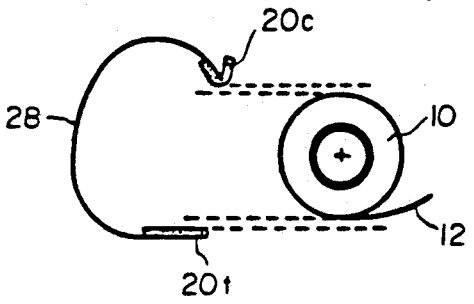
FIG. 17 shows such a magazine with its film withdrawal lips pulled open.

Using commercially available software such as NASTRAN published by the McNeal Schwendler Corporation for modelling preformed metal shell 18, a simplified computer based model of the shell is created as illustrated in FIG. 16. Assuming that lip **20*t* is held fast; that there are no internal stresses in the shell; that the material of the shell has the lowest yield strength anticipated in the actual product and the actual thickness to be used in the product; and that the stress-strain curve of the material has a positive slope, shell 18 is deflected by applying force to lip 20*c*, pulling upward and spreading the lips as viewed in FIG. 17 while permitting lip 20*c* to move laterally if needed. The force is then removed and the model is allowed to relax to its free standing condition. The force applied is increased or decreased until the spacing between lips 20*c*,20*t* in the relaxed condition is sufficient to permit lateral insertion of a prewound spool. This technique produces a model of very open form shell 28 as shown in FIG. 2 and FIG. 17**.

Figure 18:
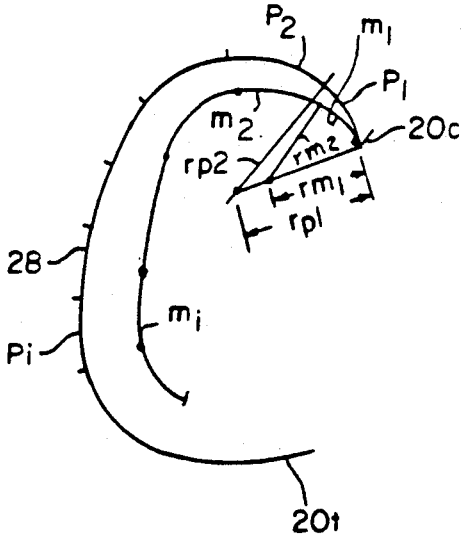
FIG. 18 shows a geometric construction illustrating how the geometry of the mandrel can be determined from the open shell geometry of FIG. 17.
Figure 19:
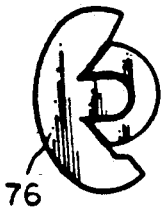
FIG. 19 shows an end view of a mandrel having an exterior surface configured in accordance with the construction of FIG. 18.

Using finite element analysis and assuming that the model of very open shell 28 has no internal stresses and no memory of having once been round as in FIG. 16, as would be the case for a shell formed from an originally flat blank, the model can then be closed back to the configuration of FIG. 16 to confirm that the shell will close to a good, cylindrical shape suitable for installation of end caps. Then, using material of the desired thickness and the lowest anticipated yield strength, a series of tests are conducted to develop plots showing for mandrels of different radii, the radii to which parts spring back following roll forming around the mandrel; that is, plots of part radius versus mandrel radius. Such plots can be modeled using commercially available software and it can be shown that $$R_{part}=0.5t+e-[a-bR_{mandrel}+c(R_{mandrel})^2],$$

where t is the thickness of the shell material and a,b and c are constants. Then, as shown in FIG. 18, the model of very open form shell 28 is broken into small but not necessarily equal length arc segments $P_1$ to $P_i$ along its circumference. From the computer model of very open shell 28, the radius $r_{p1}$ of shell 28 at lip 20c can be determined, which is the radius at the beginning of segment $P_1$. From the value of $r_{p1}$, the corresponding radius $r_{m1}$ of mandrel 76 to produce $r_{p1}$ can be calculated using the relationship given above. With minor adjustment for the thickness of the wall of shell 28, the length of segments $P_1$ to $P_i$ along the circumference of the shell will be about the same as corresponding segments $M_1$ to $M_i$ along the circumference of the mandrel. Using radius $r_{m1}$ and assuming that the radius is perpendicular to the beginning of its corresponding segment $M_1$ near lip 20c, the location of the center for $r_{m1}$ can be determined and segment $M_1$ can be constructed as illustrated. Then, the computer determines from the model for shell 28 the radius $r_{p2}$ for the beginning of segment $P_2$, calculates $r_{m2}$, locates the center for $r_{m2}$ and constructs segment $M_2$ of the surface of the mandrel. This process is then repeated for each segment of very open form shell 28 until the geometry of a mandrel surface has been determined, as shown in FIG. 19, on which shell blanks can be roll formed to produce a very open form shell 28. Because the shape of the mandrel is determined using the lowest yield strength material, the mandrel will produce proper very open form shells 28 with higher yield strength materials as well and such shells will also close to a good cylindrical form.

SHELL REMOVAL STATION 42

Figure 20:
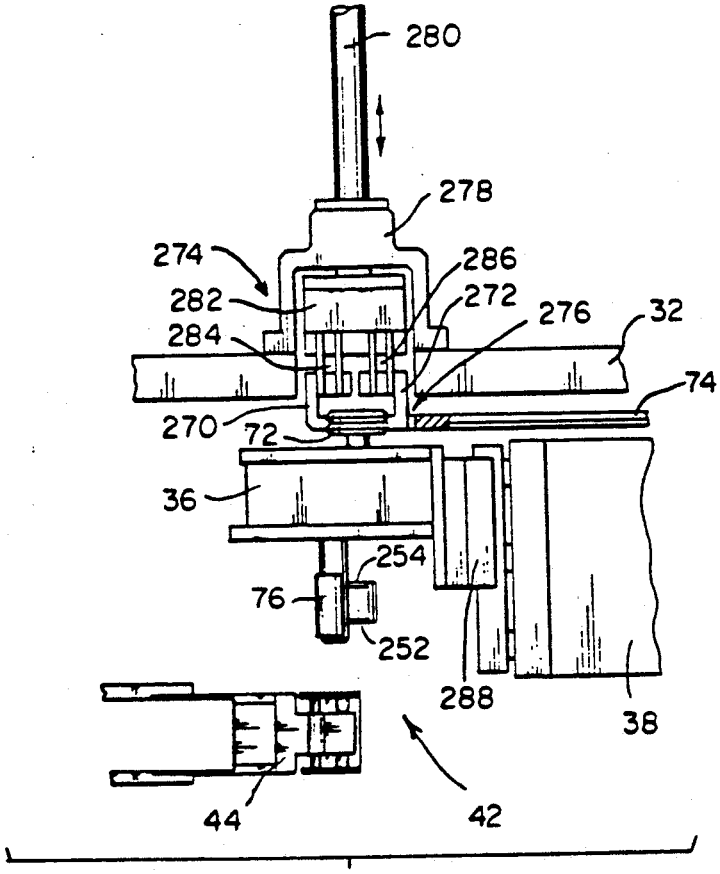
FIG. 20 shows a fragmentary top plan view of the roll forming mechanism, illustrating the mechanism which moves the mandrel carrier outward to deliver the very open shell to the means for removing the shell according to the present invention.
Figure 21:
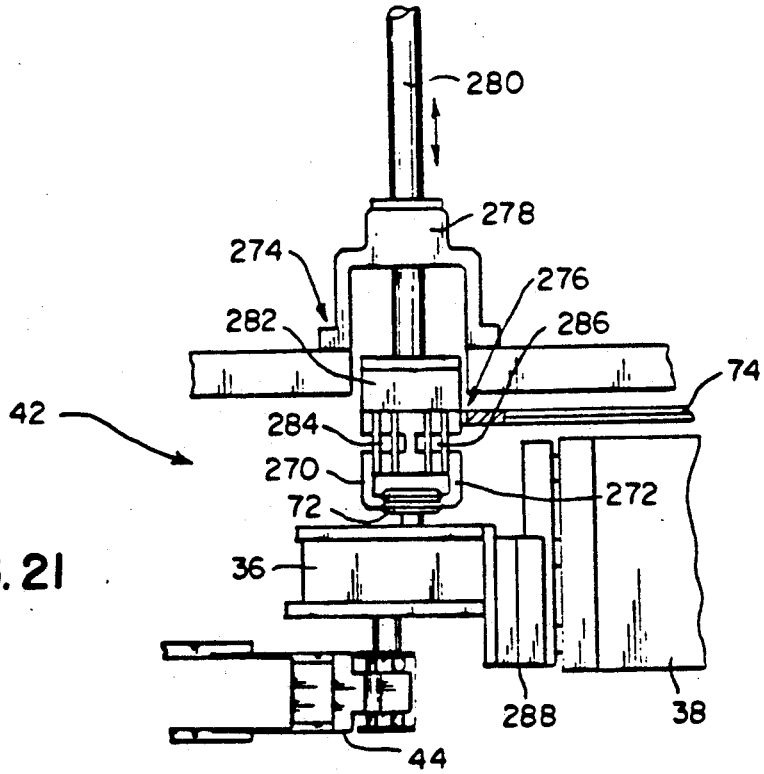
FIG. 21 shows the mechanism of FIG. 20 with the mandrel inserted into the means for removing the shell.

When mandrel carrier 36 reaches shell removal station 42 as shown in FIG. 20, grooved guide wheel 72 rolls from guide track 74 to a position between the jaws 270,272 of a mechanism 274 mounted on face plate 32. Mechanism 274 is configured to move mandrel carrier 36 outward from the position of FIG. 20 to the position of FIG. 21 in which very open shell 28 is accessible to the shell removal mechanism 44 according to the present invention. In the position of FIG. 20, jaws 270,272 extend into a circumferentially extending gap 276 in guide track 74; so that, as guide wheel 72 leaves guide track 74, it moves directly between the jaws. Only the radially inner portion of gap 276 is visible in FIGS. 20 and 21. Mechanism 274 comprises a housing 278 mounted on the back side of face plate 32, a spline shaft 280 supported by housing 278 for sliding movement and extended through an opening in face plate 32, and a conventional oscillator, not illustrated, for moving shaft 280 between the positions of FIGS. 20 and 21. Attached to the end of shaft 280 is a mounting block 282 to which are attached pairs 284,286 of stiff leaf springs which in turn are attached to jaws 270,272, respectively. When guide wheel 72 moves between jaws 270,272, springs 284,286 are deflected radially outward; so that, the jaws are biased into engagement with the guide wheel. Each mandrel carriage 36 is attached to forming dial 38 by means of a slide 288 which, once guide wheel 72 has left guide track 74, permits movement of mandrel carriage 36 between the positions of FIGS. 20 and 21. Thus, when mandrel carriage 36 reaches the position of jaws 270,272, forming dial 38 is stopped and mechanism 274 is actuated to move carriage 36 outwardly, essentially parallel to the axis of rotation of dial 38, to the position of FIG. 21.

Figure 22:
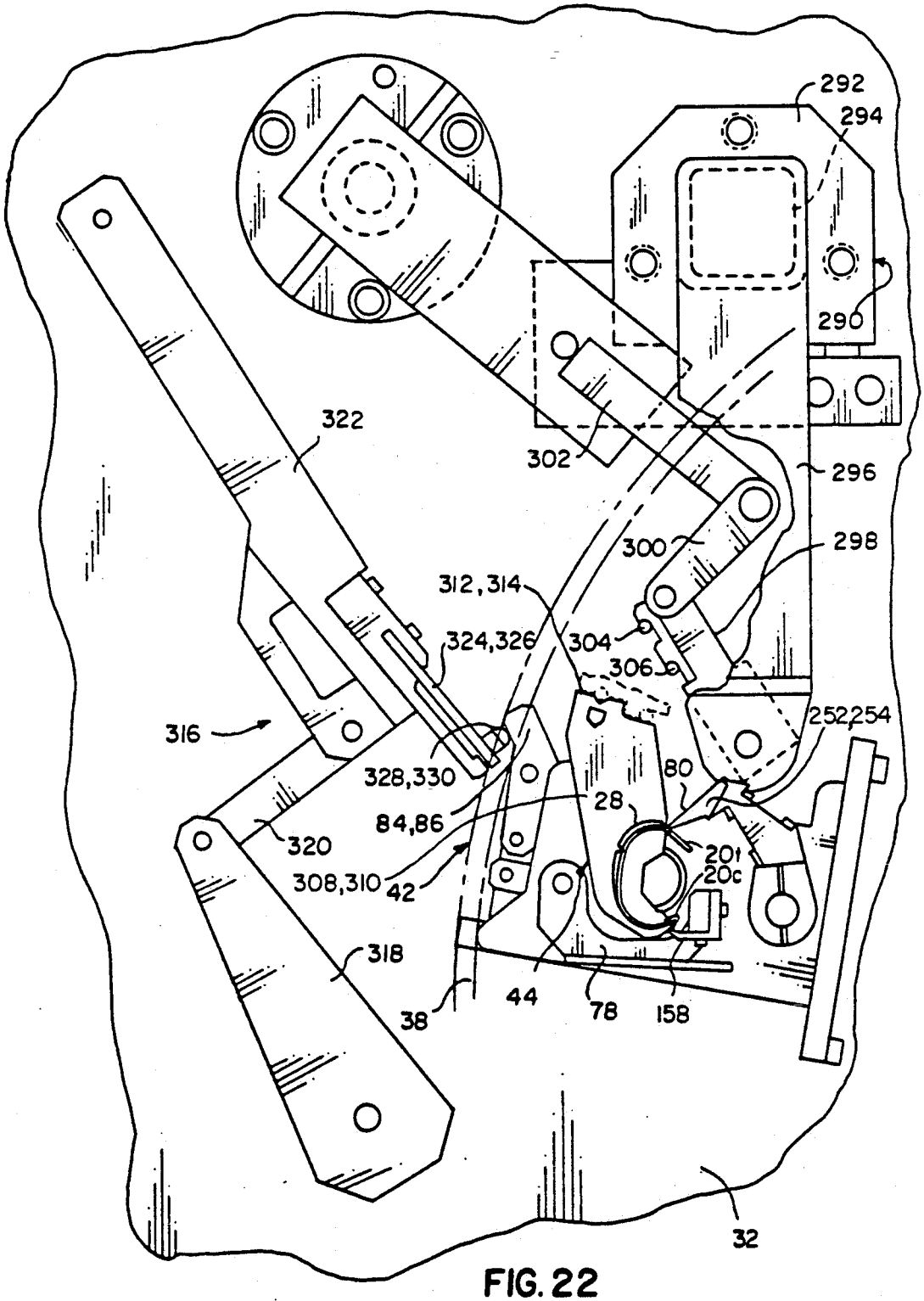
FIG. 22 shows a fragmentary front elevation view of the mechanism of FIG. 4 after the forming dial has been rotated 180 degrees counterclockwise, illustrating the cooperation between the mandrel and the means which removes the very open shell from the mandrel.

FIG. 22 shows a front elevation view of shell removal station 42. As mandrel carrier 36 is indexed into the illustrated position, it passes behind a portion of support structure 290 which is attached to face plate 32 by means of an adaptor plate 292. Extending out of the plane of the figure from plate 292 is an arm 294, illustrated in phantom, from which depends a further arm 296. Thus, mandrel carrier 36 passes between face plate 32 and arm 296 to reach the illustrated position. The lower end of arm 296 pivotably supports a reference datum arm 298 whose opposite end is pivotably attached to a link 300 which in turn is pivotably attached to a crank arm 302 pivotably mounted to face plate 32. When crank arm 302 is rotated clockwise by a conventional oscillator, not illustrated, datum arm 298 moves to the position illustrated in phantom. Datum arm 298 includes on its under side a pair of transversely extending positioning bars 304,306 which in the phantom position provide a reference or docking location for shell removal mechanism 44 of the present invention, only a fragment of which is illustrated in FIG. 22. Mechanism 44, which will be discussed in detail subsequently, comprises a pair of spaced claws 308,310, only the outermost one of which is visible in FIG. 22, which are swung into the illustrated position just before mandrel carrier 36 arrives. The openings of claws 308,310 are size so that when mandrel carrier 36 is moved outwardly by mechanism 274, mandrel 76 and very open shell 28 move through the openings in claws 308,310 while lips 20c,20t remain outside the openings and held against the mandrel by hook 158 and clamping fingers 252,254, respectively. Along their edges remote from such openings, claws 308,310 include reference edges 312,314, only the outermost one of which is visible in FIG. 22. Just before claws 308,310 are swung into the illustrated position, datum arm 298 is moved to the illustrated phantom position. Positioning bars 304,306 are thus located so that reference edges 312,314 will contact them and accurately position claws 308,310 to allow mandrel 76 and very open shell 28 to enter.

Once mandrel 76 and very open shell 28 have been positioned within the openings of claws 308,310, hook 158 and clamping fingers 252,254 must be released to permit the shell to spring into the openings of the claws for subsequent removal from mandrel 76. For this purpose, a toggle release mechanism 316 is provided which in one embodiment may comprise a crank arm 318 rotatably mounted to face plate 32, a link arm 320 pivotably connected to the outer end of crank arm 318 and a release arm 322 pivotably connected near one end to link arm 320 and pivotably mounted at the other end to face plate 32. Crank arm 318 may be driven by a conventional oscillator, not illustrated. At its free end, release arm 322 supports a pair 324,326 of stiff leaf springs having toggle release buttons 328,330 located on their outer ends, only the outermost leaf spring and release button being visible in FIG. 22. When release buttons 328,330 are pressed against the free ends of trip arms 142 and 172 of mandrel carrier 36, toggle mechanisms 84,86 are released and very open shell 28 springs into the embrace of the openings in claws 308,310.

Figure 23:
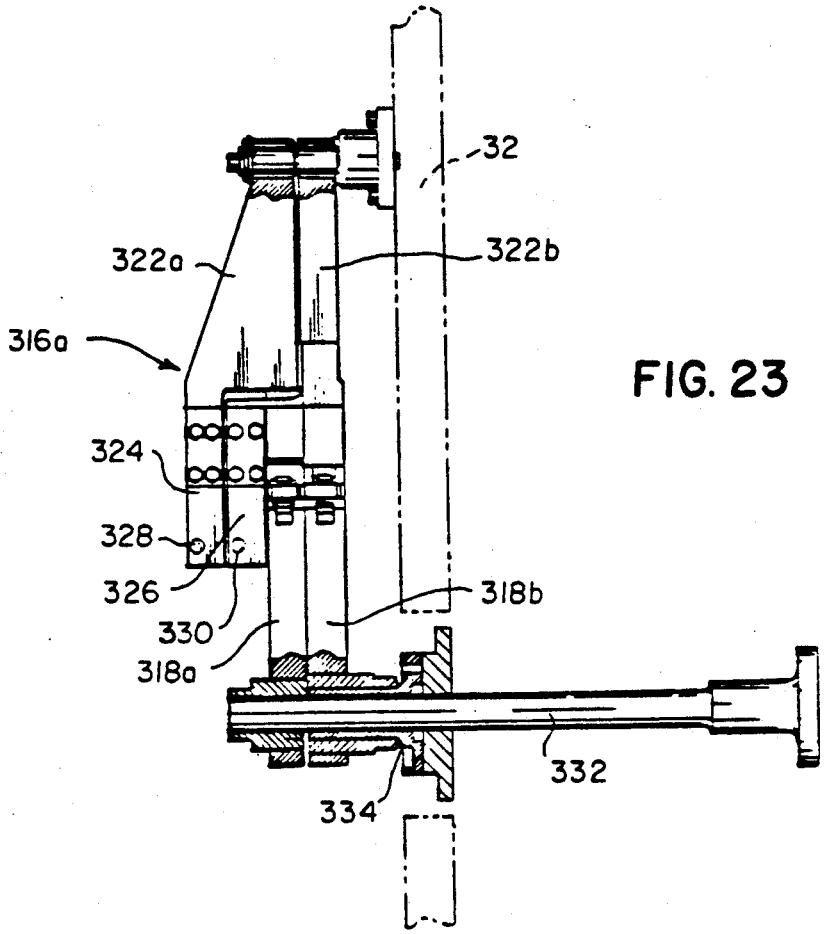
FIG. 23 shows a side elevation view, partially in section of the mechanism for releasing the clamps holding the shell against the mandrel in FIG. 22.
Figure 24:
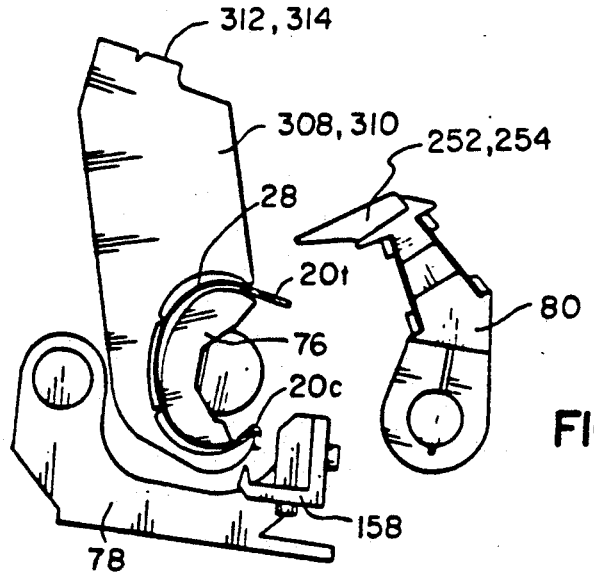
FIG. 24 shows an enlarged fragmentary front elevation view of the mandrel within the means for removing after release of the clamps, illustrating how the shell springs open into the means for removing the shell according to the present invention.

In a toggle release mechanism as just described, release buttons 328,330 would tend to release toggle mechanisms 84,86 simultaneously; so that lips 20c,20t would spring away from mandrel 76 into engagement with claws 308,310. It is preferred, however, that lip 20c be released first since its crimp tends to engage one lip of claws 308,310 and thereby guide the rest of very open shell 28 into proper engagement with the claws, after lip 20t has been released. To achieve this sequence of release, the toggle release mechanism 316a of FIG. 23 is preferred. In this instance, a first crank arm 318a is mounted for rotation with a shaft 332 extending outwardly through face plate 32 and a second crank arm 318b is mounted on a tubular shaft 334 concentric with shaft 332, thus permitting the crank arms to be independently actuated by a conventional oscillator, not illustrated, acting on shafts 332 and 334. Crank arms 318a and 318b are pivotably connected to links not visible in FIG. 23 but identical in function to link 320, which links are pivotably connected to release arms 322a,322b. Thus, by rotating shaft 332 before shaft 334, release arm 322a is rotated to press release button 328 against the free end of trip arm 142 and release clamping arm 78 just before release arm 322b is rotated to press release button 330 against the free end of trip arm 172 and release clamping arm 80. FIG. 24 shows a fragmentary view of the structure of FIG. 22 after clamping arms 78,80 have been released and very open shell 28 has sprung away from mandrel 76 into engagement with claws 308,310.

Figure 25:
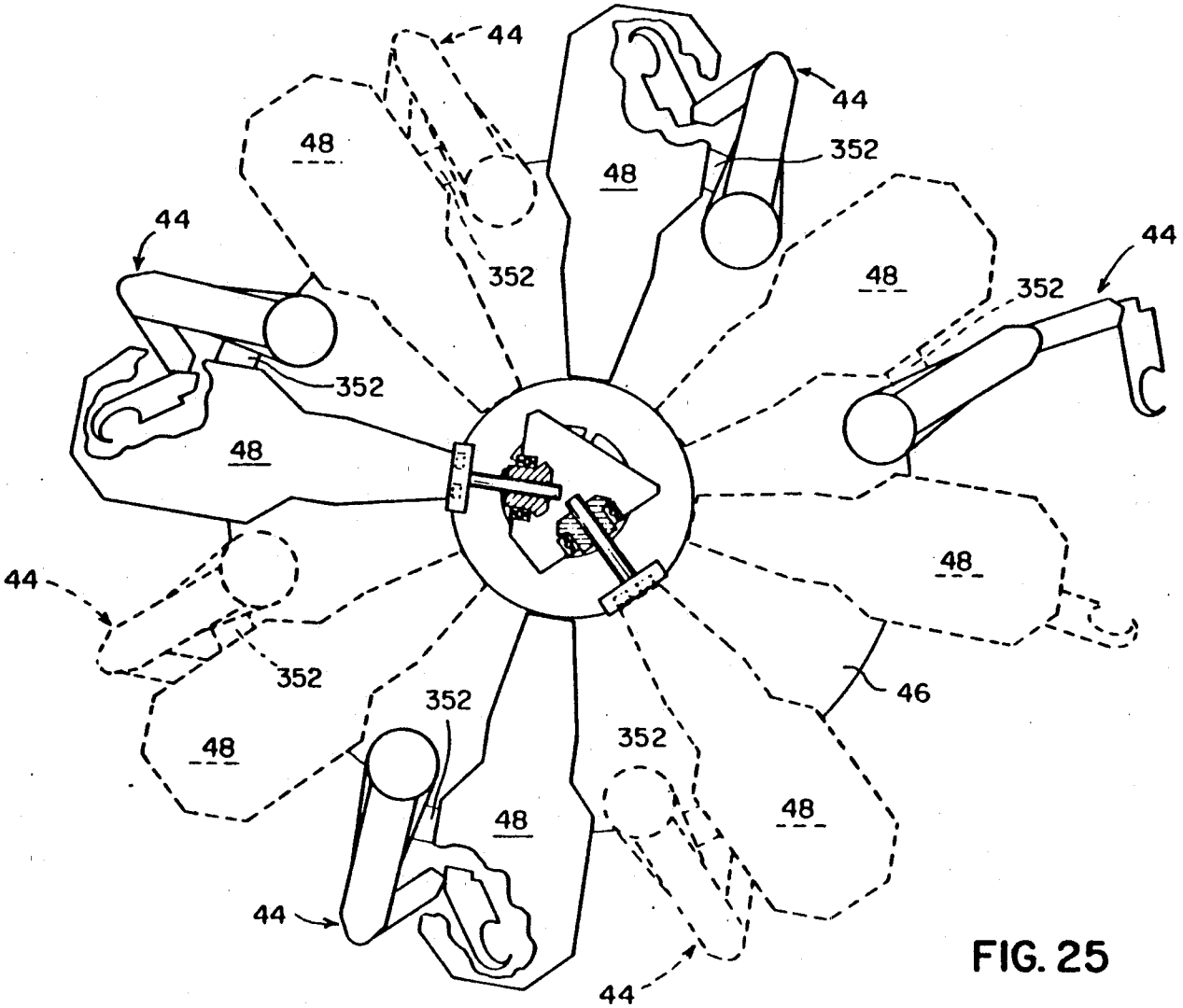
FIG. 25 shows a schematic, partially fragmentary front elevation view of the mechanisms according to the invention which remove a roll formed shell from the mandrel for delivery to an assembly station where a prewound spool is inserted into the shell.

Once very open shell 28 has been released into claws 308,310 and mandrel 76 has been retracted, the shell is swung away from forming dial 38 by shell removal mechanism 44 according to the present invention, which is supported by the adjacent assembly dial 46, illustrated schematically in FIG. 25. Assembly dial 46 comprises an annular plate mounted for rotation relative to face plate 32 by a conventional indexer, not illustrated. Around the periphery of assembly dial 46 is arranged a plurality of end cap applying mechanisms 48, illustrated only schematically; and on one side of each mechanism 48 is mounted a shell removal mechanism 44 according to the present invention, some of which are shown in solid lines in FIG. 25, some of phantom lines.

Figure 26:
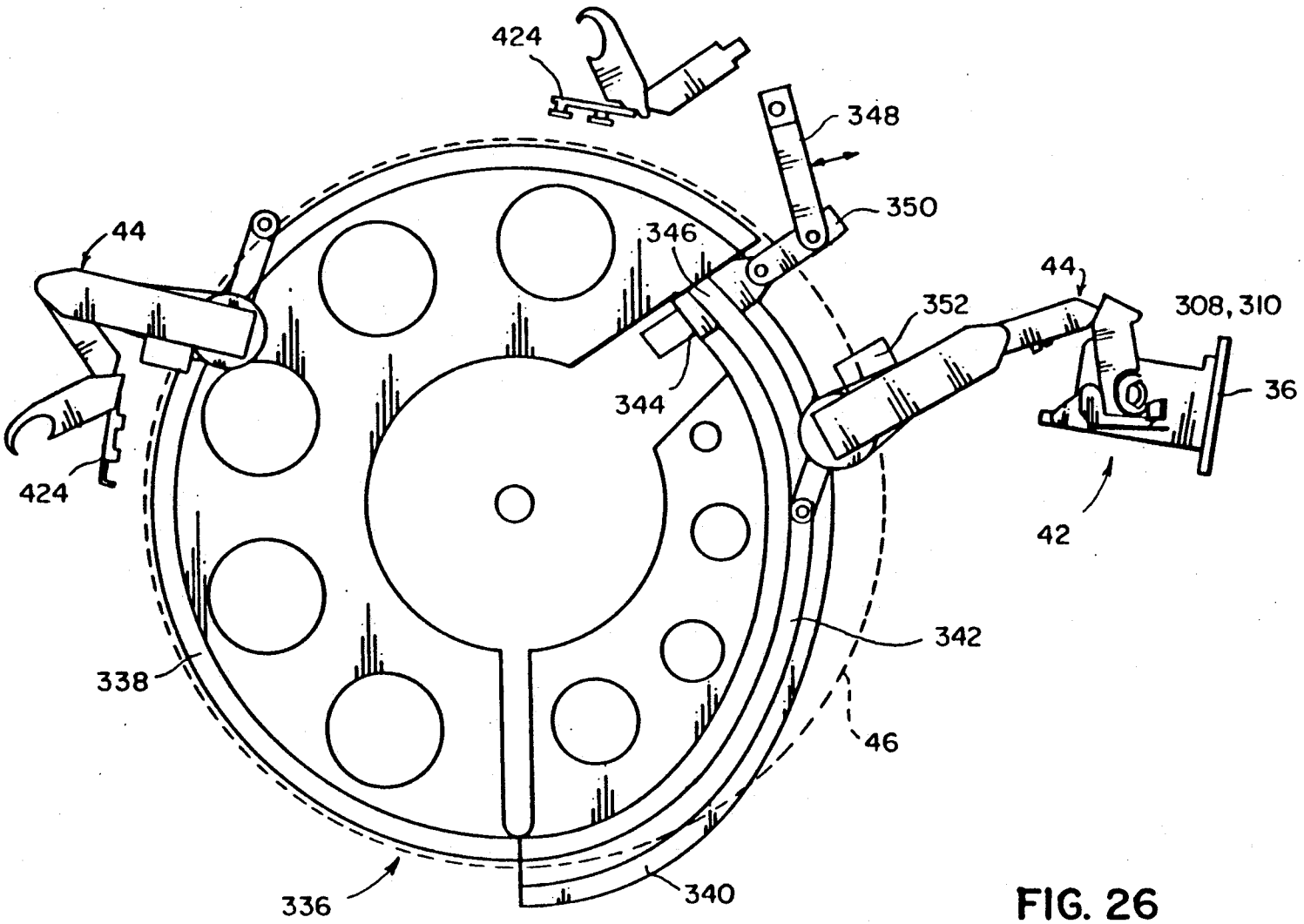
FIG. 26 shows the stationary cam plate which actuates the means for removing a roll formed shell.

As shown in FIG. 26, behind assembly dial 46 and rigidly attached to face plate 32 is an essentially annular cam plate 336 which cooperates with a cam follower on shell removal mechanism 44 to swing very open shell 28 away from shell removal station 42 and place the shell in position for cooperation with one of end cap applying mechanisms 48. As seen in FIG. 26, cam plate 336 comprises a dwell segment 338 extending over approximately five eighths of the circumference of the plate and a decreasing radius segment 340 extending over the remainder of the circumference. As assembly dial 46 is rotated clockwise as viewed in FIG. 26, the cam follower of each shell removal mechanism 44 rolls from the outside edge of dwell segment 338 into a slot 342 in decreasing radius segment 340, just as the associated end cap applying mechanism 48 is rotated away from the station at which complete magazines are removed, not illustrated. Subsequently, each cam follower is shifted from segment 340 back to segment 338, one indexing step after the associated end cap applying mechanism 48 is rotated away from shell removal station 42. This shifting of each cam follower is accomplished by means of a radially movable switch plate 344 having a slot segment 346 which can be positioned to receive a cam follower from slot 342 or to deliver the cam follower to the outside edge of well segment 338. Switch plate 344 may be moved when necessary by a crank arm 348 pivotably mounted at one end to face plate 32 and pivotably connected at its other end to a link 350 which in turn is pivotably connected to the radially outer end of switch plate 344. Crank arm 348 may be driven by a conventional indexer, not illustrated.

Shell removal mechanism 44 is illustrated in FIGS. 27 to 30. A mounting plate 352 is attached to one side of each end cap applying mechanism 48 as illustrated fragmentarily in FIG. 27 and supports a transfer arm housing 354 having a rearwardly projecting shaft housing 356. Mounted for rotation within housing 356 is a shaft 358 which extends rearwardly toward face plate 32 through a bore 360 in dial 46. At its rearmost end, shaft 358 fixedly supports a cam follower 362 comprising a clamp block 364 fixedly attached to the end of shaft 358, a pair of flexure elements 366 extending from block 364 essentially parallel to cam plate 336, a roller support block 368 attached to the opposite ends of flexure elements 366 and a roller 370 rotatably supported by block 368. As assembly dial 46 is rotated, roller 370 rolls along the periphery of dwell segment 338 of cam plate 336 or through slot 342 in decreasing radius segment 340. As roller 370 traverses dwell segment 338, shaft 358 remains stationary; however, as roller 370 moves through slot 342, shaft 358 is rotated to position shell removal mechanism 44 to acquire a very open shell 28 from mandrel 76 and then to transfer the shell into position for cooperation with the associated end cap applying mechanism 48.

Figure 28:
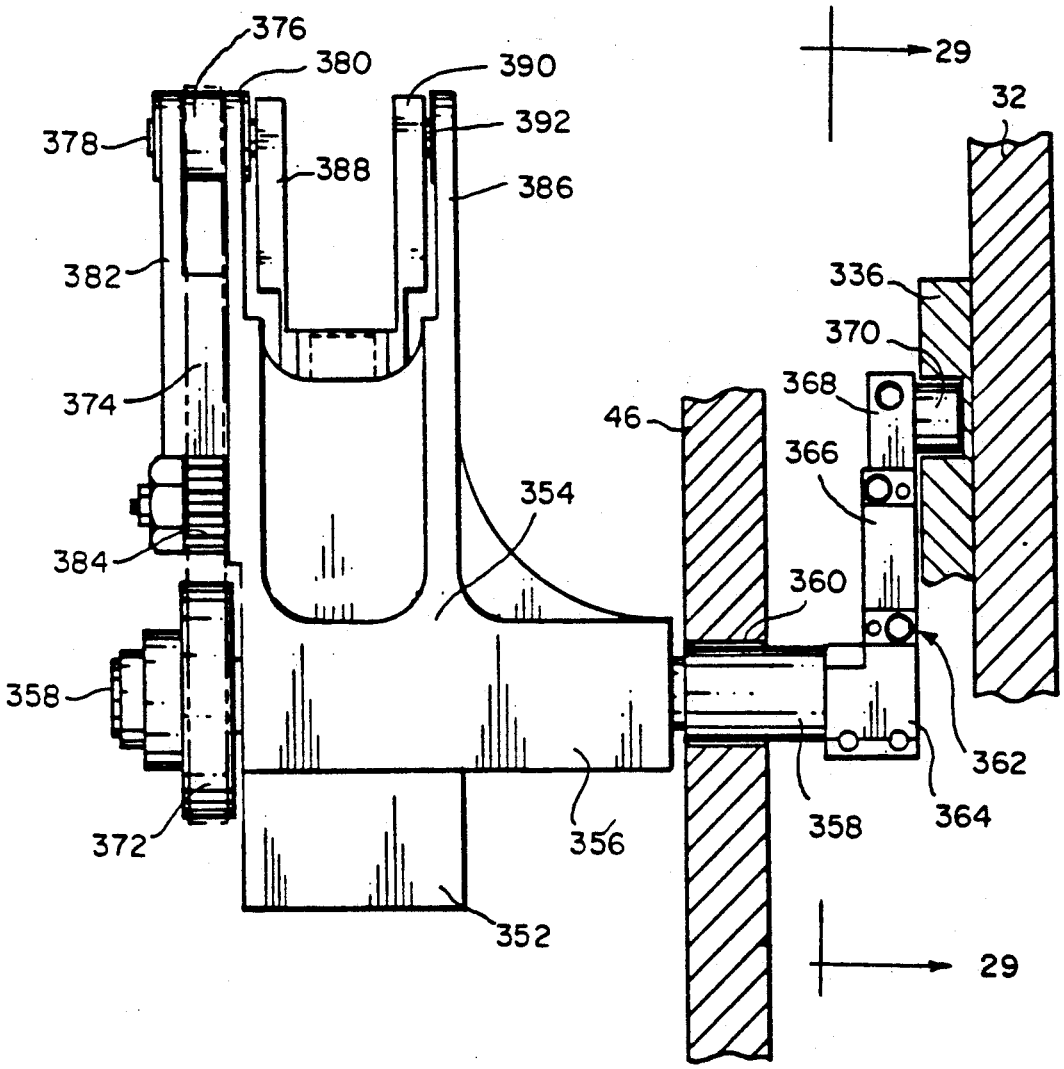
FIG. 28 shows a side elevation view of the mechanism of FIG. 27.
Figure 30:
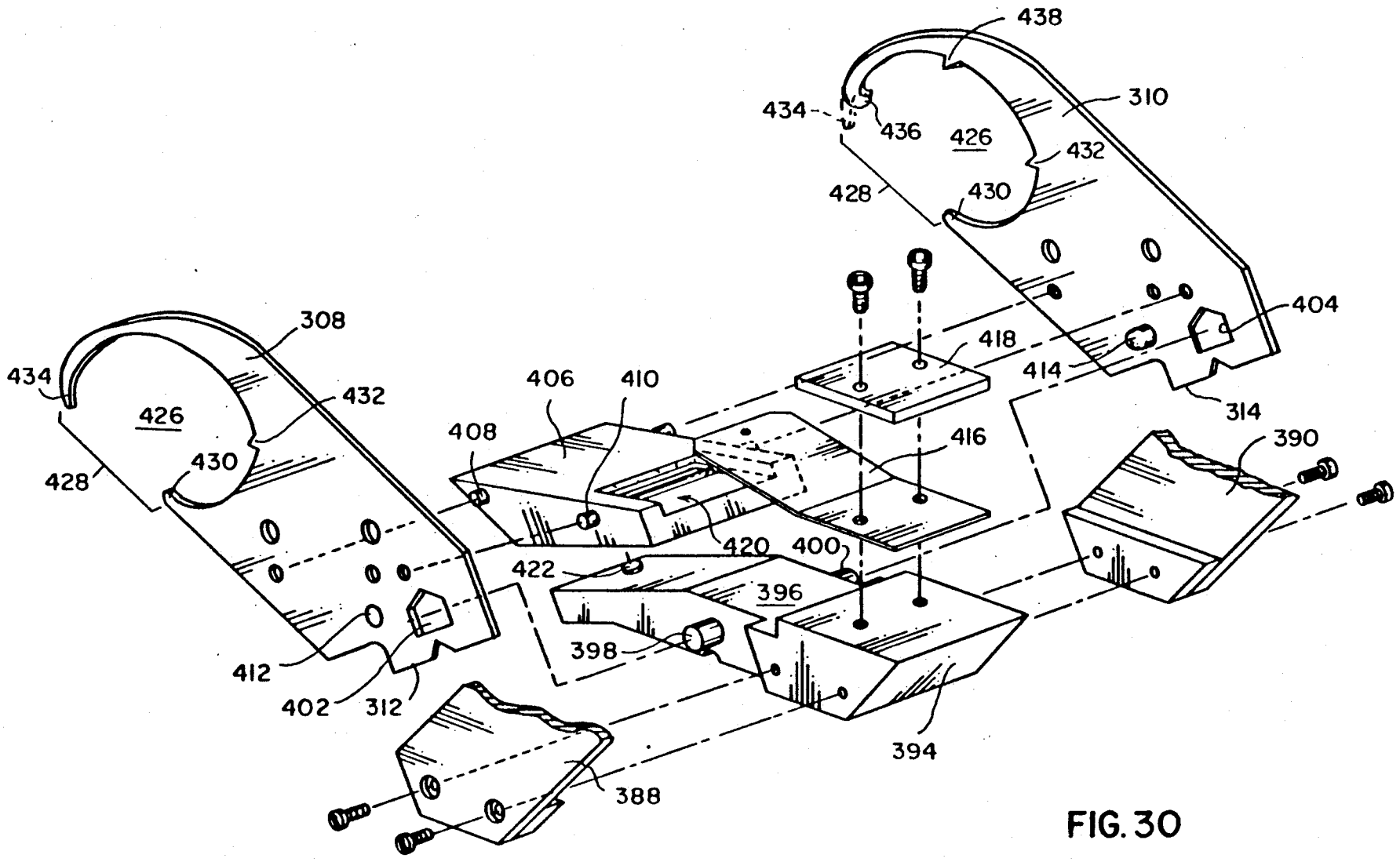
FIG. 30 shows an exploded perspective view of the nest mechanism which receives and holds the roll formed shells.

At the opposite end of shaft 358 is fixedly mounted a pulley 372 about which a timing belt 374 is wrapped. A pulley 376 is supported on a shaft 378 rotatably supported between an arm 380 extending from housing 354 essentially parallel to assembly dial 46 and a support plate 382 attached to arm 380. Timing belt 374 also is wrapped around pulley 376. The tension of timing belt 374 may be adjusted in the familiar manner using a tension roller 384 slidably mounted on the side of housing 354. To the rear of arm 380 is provided a second arm 386 extending from housing 354 essentially parallel to dial 46. A front support plate 388 is fixedly mounted for rotation with shaft 378. A rear support plate 390 is fixedly mounted on a shaft 392 rotatably mounted near the end of second arm 386 and coaxial with shaft 378. As seen in FIGS. 27, 28 and 30, support plates 388,390 extend away from shafts 378,392 and are attached at their outer ends to an elongated support base 394 for fixed claws 308,310 of shell removal mechanism 44. Base 394 includes an outwardly protruding tongue portion 396 having a pair of laterally protruding stub axles 398,400 in its side edges, axles 398,400 being loosely received in pentagonal shaped apertues 402,404 provided near reference edges 312,314 of claws 308,310. The vee-shaped sides of apertures 402,404 normally support axles 398,400, with clearances to the remaining sides of the apertures, which serve as stops against excess movement. A tie plate 406 extends between claws 308,310 and fixes the claws in parallel planes by means of through pins 408,410 which mate with corresponding apertures in the claws. A pair of bearing buttons 412,414 are attached to the inner sides of claws 308,310 facing tongue portion 396 and are provided at their rounded tips with a small clearance to tongue portion 396. Tie plate 406 is biased toward tongue portion 396 by means of a leaf spring 416 attached by a hold down plate 418 to support base 394. The outer end of spring 416 extends into a pocket 420 in tie plate 406. The movement of tie plate 406 toward tongue portion 396 is limited by a bearing button 422 centrally located near the outer end of tongue portion 396.

Because of the loose fit between stub axles 398,400 and apertures 402,404, the assembly of tie plate 406 and claws 308,310 is permitted limited universal movement relative to support base 394. In the direction transverse to support plates 388,390, this movement is limited by bearing buttons 412,414 and the side of apertures 402,404. In the direction about stub axles 398,400, this movement is limited by bearing button 422 and the sides of apertures 402,404 if the assembly is rotated toward tongue portion 396; whereas, if the assembly is rotated away from tongue portion 396, this movement is limited ultimately by contact between claws 308,310 and support plates 388,390. This range of movement is important to proper operation of the apparatus according to the invention. When shell removal mechanism 44 is swung into the position shown in FIG. 22, reference edges 312,314 must engage properly with positioning bars 304,306 on reference datum arm 298. The range of movement of the assembly of claws 308,310 and tie plate 406 ensures that the assembly will be able to orient properly against the positioning bars to facilitate subsequent acquisition of very open shell 28. End cap applying mechanisms 48 each include a similar datum element 424, shown schematically in FIGS. 26 and 27, which cooperates with the assembly of claws 308,310 and tie plate 406 to ensure that very open shell 28 is properly positioned to receive a prewound roll of film, to be closed about the film and to receive a pair of end caps.

As indicated in FIG. 30, it has been found that the openings of claws 308,310 must be somewhat differently configured to facilitate transfer of very open shell 28 from mandrel 76. Each jaw comprises a central opening 426 sizes sufficiently larger than mandrel 76 to permit axial passage of the mandrel with a shell clamped in place. Opening 426 is also sized to permit the shell to spring into and be firmly held within the central opening due to the spring force of the shell. Since the spring force of the shell causes it to spring into a fixed configuration within opening 426, changes in the material properties of the shell can be accommodated without influencing the shape of the shell as held within opening 426. Each jaw includes a throat 428 on one side of opening 426, the throat being sufficiently wide to permit lateral passage of a prewound roll of film into a very open shell 28 held between the two claws. Each claw includes on the side of throat 428 closer to support base 394 a tine 430 which engages the shell near lip 20*t*. Spaced along the circumference of opening 426 from tine 430, each jaw includes a shell positioning protrusion 432 which prevents the shell from springing open farther than necessary. On the opposite side of throat 428 from tine 430, claw 308 includes a tine 434 which engages the roll formed shell in the crimp formed by lip 20*c*. However, in the case of claw 310, a different arrangement was found necessary on the opposite side of throat 428. As previously discussed with regard to FIGS. 20, 21 and 22, mandrel 76 with a shell clamped in place is moved outwardly from forming dial 38 to a position where the shell can be removed by mechanism 44. Because clamping fingers 252,254 press against the roll formed shell near lip 20*t*, they move easily past tines 430 as mandrel 76 and the roll formed shell are moved outwardly. See FIG. 22. In contrast to this, hook member 158 is engaged in the crimp formed by lip 20*c* which would prevent the mandrel and shell from passing a tine configured like tine 434 of claw 308, if such tine were used on claw 310. So, claw 310 is provided with a tine 436 spaced circumferentially away from the path of hook member 158. For comparison, the location of a time such as tine 434 is shown in phantom on claw 310. To ensure that the end of the shell held by claw 310 is positioned identically with that held by claw 308, an additional shell positioning protrusion 438 is provided on claw 310 between tine 436 and protrusion 432.

While our invention has been shown and described with reference to particular embodiments thereof, those skilled in the art will understand that various modifications in form and detail of the apparatus and method may be made without departing from the scope and spirit of the invention.

Having thus described our invention in sufficient detail to enable those skilled in the art to make and use it, we claim as new and desire to secure Letters Patent for:

1. A method of removing a preformed metal blank having first and second axially extending lips from a mandrel having an axially extending cylindrical surface about which said blank has been formed and to which said lips have been clamped at spaced locations on said surface, said mandrel being configured so that when said blank is unclamped from said mandrel, said blank springs to an open form, comprising the steps of:
   - providing a fixture for holding said blank in said open form;
   - inserting said mandrel axially into such fixture with said blank clamped in place;
   - unclamping said axially extending lips from said surface to permit said blank to spring into said open form within said fixture; and
   - withdrawing said mandrel axially from said open form.

2. An apparatus for removing a preformed metal blank having first and second axially extending lips from a mandrel having an axially extending cylindrical surface about which said blank has been formed and to which said lips have been clamped at spaced locations on said surface, said mandrel being configured so that when said blank is unclamped from said mandrel, said blank springs to an open form, comprising:
   - a rotatable dial having an axis of rotation;
   - at least one transfer arm pivotably mounted on said rotatable dial;
   - means mounted on said transfer arm for receiving said blank from said mandrel from a direction parallel to said axis of rotation and holding said blank in said open form;
   - means responsive to rotation of said rotatable dial for pivoting said transfer arm to position said means for receiving to receive said blank from said mandrel from said direction.

3. Apparatus according to claim 2, further comprising means for orienting said means for receiving relative to said mandrel to receive said blank from said mandrel from said direction.

4. Apparatus according to claim 2, wherein said means for receiving comprises:

a pair of axially separated claw elements having axially aligned openings through both of which said mandrel and said blank can pass sequentially from said direction, said openings being sized to engage said blank at said lips and hold said blank in said open form due to the spring force of said blank after said blank has been unclamped from said mandrel;

means connected between said claw elements for maintaining the axial alignment and axial separation of said openings, so that said claw elements simultaneously can hold said blank in said open form; and means connected between said means for maintaining and said transfer arm for permiting universal movement of said means for maintaining, whereby said openings may be aligned with said mandrel.

5. Apparatus according to claim 4, further comprising means for orienting said means for receiving to receive said very open shell from said mandrel.

6. Apparatus according to claim 2, wherein said means for pivoting said transfer arm comprises:

a cam track surrounding said axis of rotation; and cam follower means connected to said transfer arm and engaged with said cam track for pivoting said transfer arm to position said means for receiving to receive said blank in said open form.

7. Apparatus according to claim 6, further comprising a support member extending radially from said rotatable dial; a first pulley mounted for rotation on said support member and connected to said cam follower means; a second pulley mounted for rotation on said support member and connected to said transfer arm; and a belt extended around said first and second pulleys, whereby movement of said cam follower means causes said pulleys to rotate to position said transfer arm.

8. A fixture for receiving a preformed metal blank having first and second axially extending lips from a mandrel having an axially extending cyclindrical surface about which said blank has been formed and to which said lips have been clamped at spaced locations on said surface, said mandrel being configured so that when said blank is unclamped from said mandrel, said blank springs to an open form, said fixture comprising a pair of axially separated, fixed claw elements having axially aligned openings through both of which said mandrel and said blank can pass axially and sequentially with said blank formed and clamped in place on said mandrel, said openings being sized to engage said blank at said lips and hold said blank in said open form due to the spring force of said blank after said blank has been unclamped from said mandrel; and means connected between said claw elements for providing fixed axial alignment and axial separation of said openings so that said claw elements simultaneously can hold said blank.

9. An apparatus for removing a preformed metal blank from a mandrel about which said blank has been formed and clamped in place, said mandrel being configured so that when said blank is released from said mandrel, said blank springs to an open form, comprising:

a rotatable dial having an axis of rotation;

at least one transfer arm pivotably mounted on said rotatable dial;

means mounted on said transfer arm for receiving said blank from said mandrel and holding said blank in said open form, said means for receiving comprising a pair of spaced claw elements having aligned openings through which said mandrel and said blank can pass, said openings being sized to hold said blank in said open form; means connected between said claw elements for maintaining the alignment of said openings; and means connected between said means for maintaining and said transfer arm for permitting univeral movement of said means for maintaining, whereby said openings may be aligned with said mandrel; and means responsive to rotation of said rotatable dial for pivoting said transfer arm to position said means for receiving to receive said blank from said mandrel.

10. Apparatus according to claim 9, further comprising means for orienting said means for receiving to receive said very open shell from said mandrel.

11. An apparatus for removing a preformed metal blank from a mandrel about which said blank has been formed and clamped in place, said mandrel being configured so that when said blank is released from said mandrel, said blank springs to an open form, comprising:

a rotatable dial having an axis of rotation;

at least one transfer arm pivotably mounted on said rotatable dial;

means mounted on said transfer arm for receiving said blank from said mandrel and holding said blank in said open form;

means responsive to rotation of said rotatable dial for pivoting said transfer arm to position said means for receiving to receive said blank from said mandrel, said means for pivoting said transfer arm comprising a cam track surrounding said axis of rotation; and cam follower means connected to said transfer arm and engaged with said cam track for pivoting said transfer arm to position said means for receiving to receive said blank in said open form; and a support member extending radially from said rotatable dial; a first pulley mounted for rotation on said support member and connected to said cam follower means; a second pulley mounted for rotation on said support member and connected to said transfer arm; and a belt extended around said first and second pulleys, whereby movement of said cam follower means causes said pulleys to rotate to position said transfer arm.

* * * * *